US008740570B2

(12) United States Patent
Stein et al.

(10) Patent No.: US 8,740,570 B2
(45) Date of Patent: Jun. 3, 2014

(54) TURBINE BUCKET AIRFOIL PROFILE

(75) Inventors: Alexander Stein, Simpsonville, SC (US); Bradley Taylor Boyer, Greenville, SC (US); Xiaoyong Fu, Greer, SC (US); Randall Richard Good, Simpsonville, SC (US); William Scott Zemitis, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 381 days.

(21) Appl. No.: 13/304,734

(22) Filed: Nov. 28, 2011

(65) Prior Publication Data

US 2013/0136610 A1 May 30, 2013

(51) Int. Cl.
*F01D 5/14* (2006.01)

(52) U.S. Cl.
USPC ..... 416/223 A; 416/243

(58) Field of Classification Search
USPC ..... 416/243, 223 R, 223 A
See application file for complete search history.

(56) References Cited

U.S. PATENT DOCUMENTS 5,980,209 A 11/1999 Barry et al.
6,450,770 B1 9/2002 Wang et al.
6,461,109 B1 10/2002 Wedlake et al.
6,474,948 B1 * 11/2002 Pirolla et al. ..... 416/243
6,851,931 B1 * 2/2005 Tomberg ..... 416/189
6,884,038 B2 * 4/2005 Hyde et al. ..... 416/223 A
6,887,041 B2 5/2005 Coke et al.
6,910,868 B2 6/2005 Hyde et al.
6,994,520 B2 2/2006 Humanchuk et al.
7,001,147 B1 2/2006 Phillips et al.
7,329,093 B2 2/2008 Vandeputte et al.
7,467,920 B2 12/2008 Sullivan et al.
7,497,663 B2 3/2009 McRae, Jr. et al.
7,527,473 B2 5/2009 Humanchuk et al.
7,731,483 B2 6/2010 DeLong et al.
7,837,445 B2 11/2010 Benjamin et al.
7,988,420 B2 8/2011 Arness et al.
7,993,100 B2 8/2011 Bonini et al.
7,997,861 B2 8/2011 Hudson et al.
8,038,390 B2 10/2011 Hudson et al.

* cited by examiner

*Primary Examiner* — Dwayne J White
(74) *Attorney, Agent, or Firm* — James W. Pemrick; Ernest G. Cusick; Frank A. Landgraff

(57) ABSTRACT

A turbine bucket is provided including a bucket airfoil having an airfoil shape, the bucket airfoil having a nominal profile substantially in accordance with Cartesian coordinate values of X, Y and Z set forth in Table 1 wherein the Cartesian coordinate values of X, Y and Z are non-dimensional values from 0% to 100% convertible to dimensional distances in inches by multiplying the Cartesian coordinate values of X, Y and Z by a height of the airfoil in inches, and wherein X and Y are distances in inches which, when connected by smooth continuing arcs, define airfoil profile sections at each distance Z, the airfoil profile sections at Z distances being joined smoothly with one another to form a complete airfoil shape.

18 Claims, 2 Drawing Sheets

TURBINE BUCKET AIRFOIL PROFILE

RELATED APPLICATIONS

The present application is related to the following co-pending application Ser. Nos. 13/304,720, 13/304,725, 13/304,732, 13/304,743, all filed concurrently herewith.

BACKGROUND OF THE INVENTION

The present application and the resultant patent relate generally to a turbine bucket for a gas turbine engine and more particularly relate to a bucket airfoil profile for a turbine stage.

In a gas turbine, many system requirements should be met at each stage of the gas turbine so as to meet design goals. These design goals may include, but are not limited to, overall improved efficiency and airfoil loading capability. For example, a turbine bucket airfoil profile should achieve thermal and mechanical operating requirements for that particular stage. Moreover, component lifetime and cost targets also should be met.

There is thus a desire therefore for an improved turbine bucket airfoil profile for use in a turbine and the like. Such an improved airfoil design should achieve performance objectives and improve overall gas turbine performance in a component with a long lifetime and reasonable manufacture and operating costs.

BRIEF DESCRIPTION OF THE INVENTION

An aspect of the present invention may be embodied by a turbine bucket including a bucket airfoil having an airfoil shape, the bucket airfoil having a nominal profile substantially in accordance with Cartesian coordinate values of X, Y and Z set forth in Table 1 wherein the Cartesian coordinate values of X, Y and Z are non-dimensional values from 0% to 100% convertible to dimensional distances by multiplying the Cartesian coordinate values of X, Y and Z by a height of the airfoil, and wherein X and Y are distances which, when connected by smooth continuing arcs, define airfoil profile sections at each distance Z, the airfoil profile sections at Z distances being joined smoothly with one another to form a complete airfoil shape.

An aspect of the present invention may be embodied in a turbine bucket including a bucket airfoil having a suction-side uncoated nominal airfoil profile substantially in accordance with suction-side Cartesian coordinate values of X, Y and Z set forth in Table 1 wherein the Cartesian coordinate values of X, Y and Z are non-dimensional values from 0% to 100% convertible to dimensional distances by multiplying the Cartesian coordinate values of X, Y and Z by a height of the airfoil, and wherein X and Y are distances which, when connected by smooth continuing arcs, define airfoil profile sections at each Z distance, the airfoil profile sections at the Z distances being joined smoothly with one another to form a complete suction-side airfoil shape, the X, Y and Z distances being scalable as a function of the same constant or number to provide a scaled-up or scaled-down airfoil.

An aspect of the present invention may be embodied in a turbine comprising a turbine wheel having a plurality of buckets, each of the buckets including an airfoil having a suction-side airfoil shape, the airfoil having a nominal profile substantially in accordance with suction-side Cartesian coordinate values of X, Y and Z set forth in Table 1 wherein the Cartesian coordinate values of X, Y and Z are non-dimensional values from 0% to 100% convertible to dimensional distances by multiplying the Cartesian coordinate values of X, Y and Z by a height of the airfoil, and wherein X and Y are distances which, when connected by smooth continuing arcs, define airfoil profile sections at each Z distance, the airfoil profile sections at the Z distances being joined smoothly with one another to form a complete suction-side airfoil shape.

These and other features and improvements of the present application and the resultant patent should become apparent to one of ordinary skill in the art upon review of the following detailed description when taken in conjunction with the several drawings and the appended claims.

DETAILED DESCRIPTION OF THE INVENTION

Figure 1:
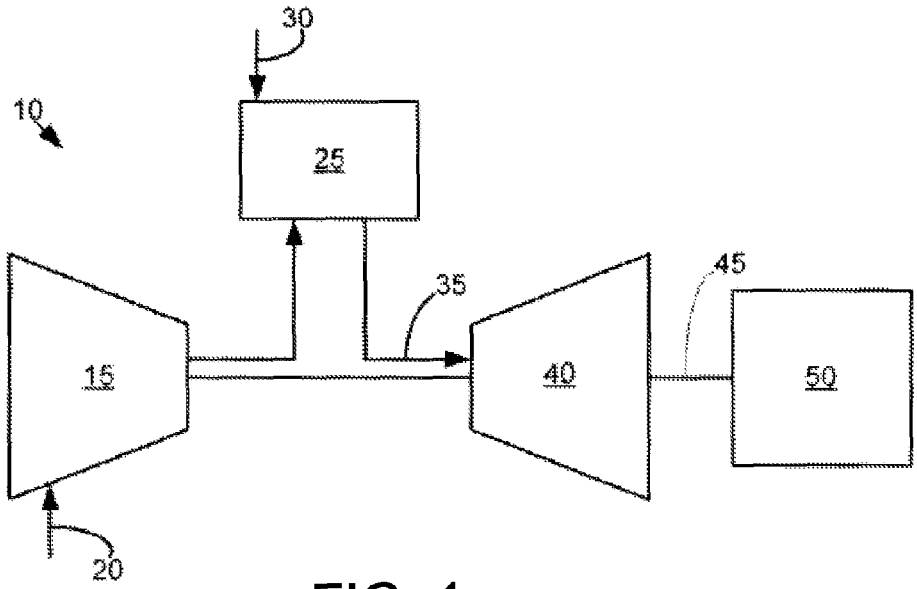
FIG. 1 is a schematic diagram of a gas turbine engine, according to an aspect of the present invention.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. It is to be understood that other types of gas turbine engines also may be used herein. Multiple gas turbine engines, other types of turbines, and other types of power generation equipment also may be used herein together.

Figure 2:
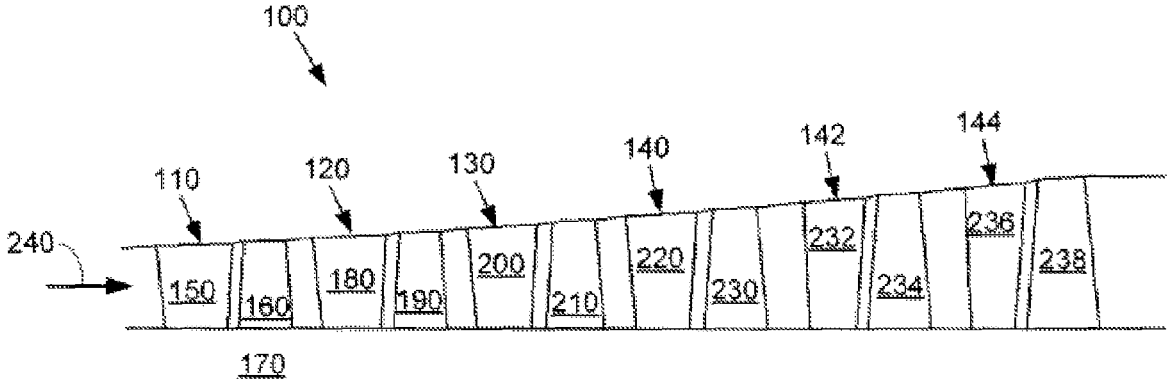
FIG. 2 is a schematic diagram of a portion of a turbine having a bucket arrangement as may be described herein, according to an aspect of the present invention.

FIG. 2 shows a schematic diagram of a turbine 100 as may be described herein. The turbine 100 may include a first stage 110, a second stage 120, a third stage 130, a fourth stage 140, a fifth stage 142, a sixth stage 144, and the like. Any number of stages may be used herein. For example, the first stage 110 may include a number of circumferentially spaced nozzles 150 and buckets 160. The first stage buckets 160 are mounted on a turbine rotor 170. The nozzles 150 are circumferentially spaced one from the other and fixed about an axis of the rotor. The second stage of the turbine 100 includes a number of circumferentially spaced nozzles 180 and a number of circumferentially spaced buckets 190 mounted on the rotor 170.

The third stage also includes a number of circumferentially spaced nozzles 200 and buckets 210 mounted on the rotor 170. The fourth stage 140 includes a number of circumferentially spaced nozzles 220 and buckets 230 mounted on the rotor 170. The fifth stage 142 includes a number of circumferentially spaced nozzles 232 and buckets 234 mounted on the rotor 170. The sixth stage 144 includes a number of circumferentially spaced nozzles 236 and buckets 238 mounted on the rotor 170. Again, any number of stages may be used herein. It will be appreciated that the nozzles and buckets lie in a hot gas path 240 of the turbine. Other components and other configurations may be used herein.

Figure 3:
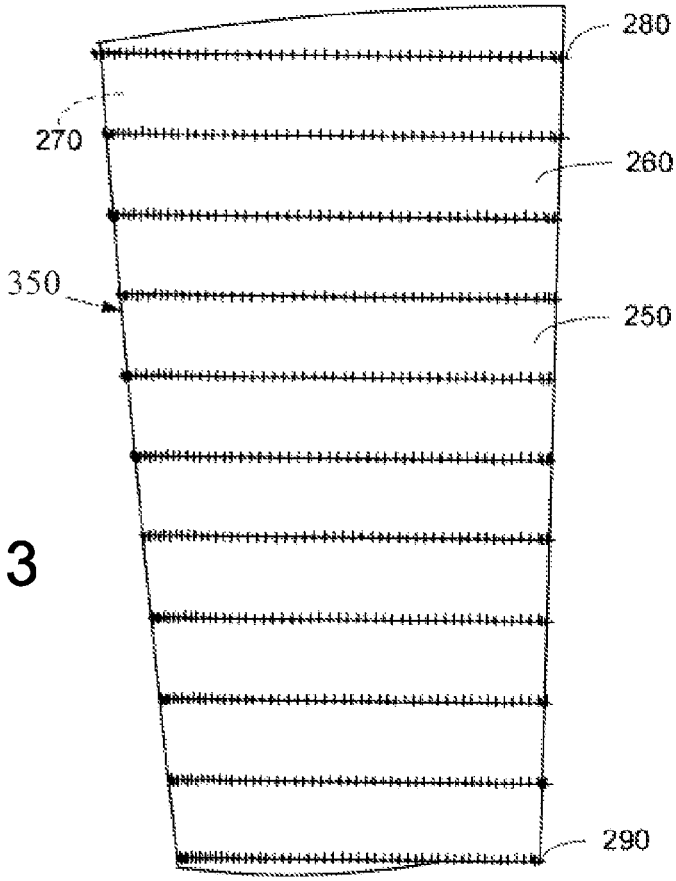
FIG. 3 is a perspective view of a portion of a turbine bucket showing an airfoil as may be described herein, according to an aspect of the present invention.
Figure 4:
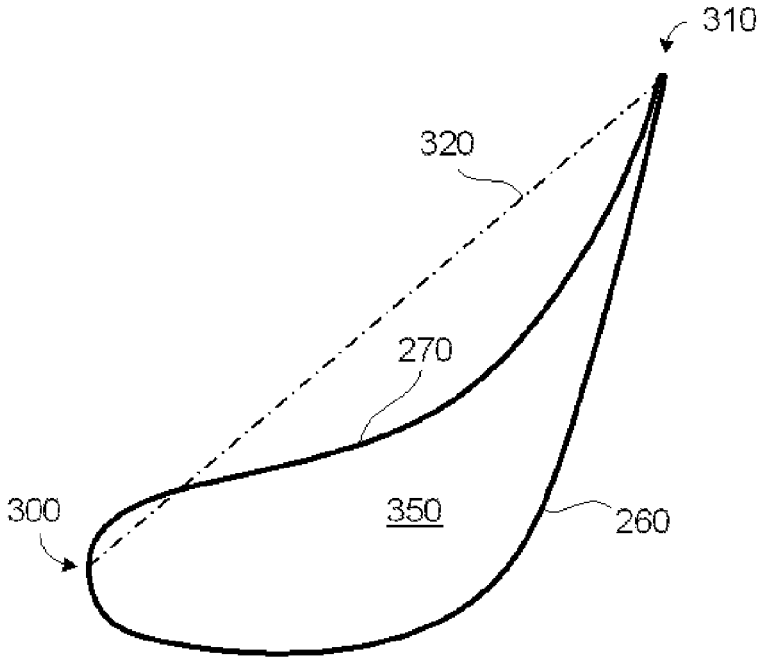
FIG. 4 is a cross-sectional view of the airfoil of FIG. 3, according to an aspect of the present invention.

Referring to FIGS. 3 and 4, it will be appreciated that each bucket 350 has a bucket airfoil 250 as illustrated. The airfoil 250 may have a suction side 260 and a pressure side 270. The suction side 260 is shown in FIG. 3 and the pressure side 270 is located on the opposing side of the airfoil 250. Thus, each of the buckets 350 has a bucket airfoil profile at any cross-section in the shape of the airfoil 250. A tip 280 is at or near the top of the airfoil 250 and a base 290 is at or near the bottom of the airfoil 250. The airfoil 250 also includes a leading edge 300 and a trailing edge 310, and a chord length 320 extends therebetween. The base 290 corresponds to the non-dimensional Z value of Table 1 at Z equals 0. The tip 280 of the bucket airfoil 250 corresponds to the non-dimensional Z value of Table 1 at Z equals 100. The X, Y, and Z values are given in percentage values of the airfoil length. As one example only, the height of the bucket airfoil 250 may be from about 4 inches to about 15 inches, about 4 inches to about 13 inches, or about 6 inches to about 9 inches. However, it is to be understood that heights below or above this range may also be employed as desired in the specific application. The airfoil 250 may be used for any stage, including but not limited to a first stage, a second stage, a third stage, a fourth stage, a fifth stage, and the like.

The gas turbine hot gas path 240 requires airfoils 250 that meet system requirements of aerodynamic and mechanical blade loading and efficiency. To define the airfoil shape of each bucket airfoil, there is a unique set or loci of points in space that meet the stage requirements and can be manufactured. These unique loci of points meet the requirements for stage efficiency and are arrived at by iteration between aerodynamic and mechanical loadings enabling the turbine to run in an efficient, safe and smooth manner. These points are unique and specific to the system. The locus that defines the bucket airfoil profile includes a set of about 2,200 points with X, Y and Z dimensions relative to a reference origin coordinate system. The Cartesian coordinate system of X, Y and Z values given in Table 1 below defines the profile of the bucket airfoil at various locations along its length. Table 1 lists data for a non-coated airfoil. The envelope/tolerance for the coordinates is about +/−5% in a direction normal to any airfoil surface location, and/or about +/−5% of the chord length 320 in a direction normal to any airfoil surface location. The point data origin is the leading edge of the base 260. The coordinate values for the X, Y and Z coordinates are set forth in non-dimensionalized units by the blade height in Table 1 although other units of dimensions may be used when the values are appropriately converted. The X, Y, and Z values set forth in Table 1 are also expressed in non-dimensional form (X, Y, and Z) from 0% to 100% of the blade or airfoil height. As one example only, the Cartesian coordinate values of X, Y and Z may be convertible to dimensional distances by multiplying the X, Y and Z values by a height of the airfoil at the trailing edge and multiplying by a constant number (e.g., 100). To convert the Z value to a Z coordinate value, e.g., in inches, the non-dimensional Z value given in Table 1 is multiplied by the Z length of the airfoil in inches. As described above, the Cartesian coordinate system has orthogonally-related X, Y and Z axes and the X axis lies generally parallel to the turbine rotor centerline, i.e., the rotary axis and a positive X coordinate value is axial toward the aft, i.e., exhaust end of the turbine. The positive Y coordinate value extends tangentially in the direction of rotation of the rotor and the positive Z coordinate value is radially outwardly toward the bucket tip. All the values in Table 1 are given at room temperature and are unfilleted.

By defining X and Y coordinate values at selected locations in a Z direction normal to the X, Y plane, the profile section or airfoil shape of the bucket airfoil, at each Z distance along the length of the airfoil can be ascertained. By connecting the X and Y values with smooth continuing arcs, each profile section at each distance Z is fixed. The airfoil profiles of the various surface locations between the distances Z are determined by smoothly connecting the adjacent profile sections to one another to form the airfoil profile.

The Table 1 values are generated and shown to three decimal places for determining the profile of the airfoil. As the blade heats up in surface, stress and temperature will cause a change in the X, Y and Z values. Accordingly, the values for the profile given in Table I represent ambient, non-operating or non-hot conditions (e.g., room temperature) and are for an uncoated airfoil.

There are typical manufacturing tolerances as well as coatings which must be accounted for in the actual profile of the airfoil. Each section is joined smoothly with the other sections to form the complete airfoil shape. It will therefore be appreciated that +/− typical manufacturing tolerances, i.e., +/− values, including any coating thicknesses, are additive to the X and Y values given in Table 1 below. Accordingly, a distance of about +/−5% in a direction normal to any surface location along the airfoil profile defines an airfoil profile envelope for this particular bucket airfoil design and turbine, i.e., a range of variation between measured points on the actual airfoil surface at nominal cold or room temperature and the ideal position of those points as given in the Table below at the same temperature. The data is scalable and the geometry pertains to all aerodynamic scales, at, above and/or below 3000 RPM. The bucket airfoil design is robust to this range of variation without impairment of mechanical and aerodynamic functions.

TABLE 1

| N | Location | X | Y | Z |
|---|---|---|---|---|
| 1 | Suction-Side | 0.000 | 0.000 | 0 |
| 2 | Suction-Side | −0.714 | 0.790 | 0 |
| 3 | Suction-Side | −1.105 | 1.784 | 0 |
| 4 | Suction-Side | −1.247 | 2.845 | 0 |
| 5 | Suction-Side | −1.219 | 3.916 | 0 |
| 6 | Suction-Side | −1.076 | 4.978 | 0 |
| 7 | Suction-Side | −0.846 | 6.025 | 0 |
| 8 | Suction-Side | −0.549 | 7.055 | 0 |
| 9 | Suction-Side | −0.199 | 8.068 | 0 |
| 10 | Suction-Side | 0.197 | 9.065 | 0 |
| 11 | Suction-Side | 0.632 | 10.046 | 0 |
| 12 | Suction-Side | 1.101 | 11.009 | 0 |
| 13 | Suction-Side | 1.601 | 11.958 | 0 |
| 14 | Suction-Side | 2.130 | 12.891 | 0 |
| 15 | Suction-Side | 2.683 | 13.808 | 0 |
| 16 | Suction-Side | 3.264 | 14.710 | 0 |
| 17 | Suction-Side | 3.867 | 15.597 | 0 |
| 18 | Suction-Side | 4.492 | 16.467 | 0 |
| 19 | Suction-Side | 5.141 | 17.321 | 0 |
| 20 | Suction-Side | 5.810 | 18.160 | 0 |
| 21 | Suction-Side | 6.500 | 18.980 | 0 |
| 22 | Suction-Side | 7.210 | 19.782 | 0 |

TABLE 1-continued

| N | Location | X | Y | Z |
|---|---|---|---|---|
| 23 | Suction-Side | 7.943 | 20.567 | 0 |
| 24 | Suction-Side | 8.695 | 21.330 | 0 |
| 25 | Suction-Side | 9.468 | 22.073 | 0 |
| 26 | Suction-Side | 10.261 | 22.793 | 0 |
| 27 | Suction-Side | 11.076 | 23.491 | 0 |
| 28 | Suction-Side | 11.912 | 24.162 | 0 |
| 29 | Suction-Side | 12.769 | 24.807 | 0 |
| 30 | Suction-Side | 13.647 | 25.421 | 0 |
| 31 | Suction-Side | 14.547 | 26.005 | 0 |
| 32 | Suction-Side | 15.467 | 26.554 | 0 |
| 33 | Suction-Side | 16.408 | 27.068 | 0 |
| 34 | Suction-Side | 17.371 | 27.539 | 0 |
| 35 | Suction-Side | 18.355 | 27.967 | 0 |
| 36 | Suction-Side | 19.356 | 28.348 | 0 |
| 37 | Suction-Side | 20.376 | 28.678 | 0 |
| 38 | Suction-Side | 21.412 | 28.953 | 0 |
| 39 | Suction-Side | 22.463 | 29.170 | 0 |
| 40 | Suction-Side | 23.524 | 29.323 | 0 |
| 41 | Suction-Side | 24.592 | 29.410 | 0 |
| 42 | Suction-Side | 25.664 | 29.429 | 0 |
| 43 | Suction-Side | 26.735 | 29.379 | 0 |
| 44 | Suction-Side | 27.800 | 29.258 | 0 |
| 45 | Suction-Side | 28.855 | 29.066 | 0 |
| 46 | Suction-Side | 29.895 | 28.806 | 0 |
| 47 | Suction-Side | 30.916 | 28.481 | 0 |
| 48 | Suction-Side | 31.915 | 28.092 | 0 |
| 49 | Suction-Side | 32.889 | 27.643 | 0 |
| 50 | Suction-Side | 33.837 | 27.142 | 0 |
| 51 | Suction-Side | 34.755 | 26.590 | 0 |
| 52 | Suction-Side | 35.647 | 25.995 | 0 |
| 53 | Suction-Side | 36.509 | 25.358 | 0 |
| 54 | Suction-Side | 37.344 | 24.684 | 0 |
| 55 | Suction-Side | 38.151 | 23.980 | 0 |
| 56 | Suction-Side | 38.932 | 23.245 | 0 |
| 57 | Suction-Side | 39.688 | 22.484 | 0 |
| 58 | Suction-Side | 40.419 | 21.701 | 0 |
| 59 | Suction-Side | 41.128 | 20.896 | 0 |
| 60 | Suction-Side | 41.815 | 20.073 | 0 |
| 61 | Suction-Side | 42.482 | 19.233 | 0 |
| 62 | Suction-Side | 43.129 | 18.378 | 0 |
| 63 | Suction-Side | 43.758 | 17.510 | 0 |
| 64 | Suction-Side | 44.369 | 16.629 | 0 |
| 65 | Suction-Side | 44.964 | 15.737 | 0 |
| 66 | Suction-Side | 45.544 | 14.835 | 0 |
| 67 | Suction-Side | 46.110 | 13.924 | 0 |
| 68 | Suction-Side | 46.663 | 13.006 | 0 |
| 69 | Suction-Side | 47.202 | 12.078 | 0 |
| 70 | Suction-Side | 47.729 | 11.145 | 0 |
| 71 | Suction-Side | 48.246 | 10.206 | 0 |
| 72 | Suction-Side | 48.750 | 9.260 | 0 |
| 73 | Suction-Side | 49.246 | 8.309 | 0 |
| 74 | Suction-Side | 49.731 | 7.353 | 0 |
| 75 | Suction-Side | 50.208 | 6.392 | 0 |
| 76 | Suction-Side | 50.677 | 5.428 | 0 |
| 77 | Suction-Side | 51.137 | 4.460 | 0 |
| 78 | Suction-Side | 51.591 | 3.489 | 0 |
| 79 | Suction-Side | 52.037 | 2.514 | 0 |
| 80 | Suction-Side | 52.476 | 1.535 | 0 |
| 81 | Suction-Side | 52.909 | 0.555 | 0 |
| 82 | Suction-Side | 53.336 | −0.429 | 0 |
| 83 | Suction-Side | 53.757 | −1.415 | 0 |
| 84 | Suction-Side | 54.172 | −2.403 | 0 |
| 85 | Suction-Side | 54.584 | −3.394 | 0 |
| 86 | Suction-Side | 54.991 | −4.386 | 0 |
| 87 | Suction-Side | 55.395 | −5.379 | 0 |
| 88 | Suction-Side | 55.796 | −6.373 | 0 |
| 89 | Suction-Side | 56.195 | −7.368 | 0 |
| 90 | Suction-Side | 56.591 | −8.365 | 0 |
| 91 | Suction-Side | 56.986 | −9.362 | 0 |
| 92 | Suction-Side | 57.377 | −10.359 | 0 |
| 93 | Suction-Side | 57.766 | −11.358 | 0 |
| 94 | Suction-Side | 58.153 | −12.360 | 0 |
| 95 | Suction-Side | 58.534 | −13.361 | 0 |
| 96 | Suction-Side | 58.912 | −14.365 | 0 |
| 97 | Suction-Side | 59.287 | −15.368 | 0 |
| 98 | Suction-Side | 59.659 | −16.375 | 0 |
| 99 | Suction-Side | 60.026 | −17.382 | 0 |
| 100 | Suction-Side | 60.226 | −18.418 | 0 |

TABLE 1-continued

| N | Location | X | Y | Z |
|---|---|---|---|---|
| 101 | Pressure-Side | 59.555 | −19.203 | 0 |
| 102 | Pressure-Side | 58.851 | −19.277 | 0 |
| 103 | Pressure-Side | 58.254 | −18.904 | 0 |
| 104 | Pressure-Side | 57.910 | −18.274 | 0 |
| 105 | Pressure-Side | 57.590 | −17.630 | 0 |
| 106 | Pressure-Side | 57.270 | −16.986 | 0 |
| 107 | Pressure-Side | 56.947 | −16.343 | 0 |
| 108 | Pressure-Side | 56.621 | −15.702 | 0 |
| 109 | Pressure-Side | 56.294 | −15.063 | 0 |
| 110 | Pressure-Side | 55.962 | −14.425 | 0 |
| 111 | Pressure-Side | 55.626 | −13.789 | 0 |
| 112 | Pressure-Side | 55.286 | −13.155 | 0 |
| 113 | Pressure-Side | 54.940 | −12.525 | 0 |
| 114 | Pressure-Side | 54.590 | −11.898 | 0 |
| 115 | Pressure-Side | 54.232 | −11.273 | 0 |
| 116 | Pressure-Side | 53.869 | −10.654 | 0 |
| 117 | Pressure-Side | 53.499 | −10.037 | 0 |
| 118 | Pressure-Side | 53.121 | −9.425 | 0 |
| 119 | Pressure-Side | 52.736 | −8.818 | 0 |
| 120 | Pressure-Side | 52.342 | −8.217 | 0 |
| 121 | Pressure-Side | 51.940 | −7.621 | 0 |
| 122 | Pressure-Side | 51.530 | −7.031 | 0 |
| 123 | Pressure-Side | 51.110 | −6.447 | 0 |
| 124 | Pressure-Side | 50.679 | −5.871 | 0 |
| 125 | Pressure-Side | 50.240 | −5.302 | 0 |
| 126 | Pressure-Side | 49.789 | −4.741 | 0 |
| 127 | Pressure-Side | 49.327 | −4.191 | 0 |
| 128 | Pressure-Side | 48.855 | −3.649 | 0 |
| 129 | Pressure-Side | 48.371 | −3.117 | 0 |
| 130 | Pressure-Side | 47.875 | −2.596 | 0 |
| 131 | Pressure-Side | 47.367 | −2.088 | 0 |
| 132 | Pressure-Side | 46.847 | −1.591 | 0 |
| 133 | Pressure-Side | 46.315 | −1.108 | 0 |
| 134 | Pressure-Side | 45.770 | −0.638 | 0 |
| 135 | Pressure-Side | 45.215 | −0.182 | 0 |
| 136 | Pressure-Side | 44.647 | 0.258 | 0 |
| 137 | Pressure-Side | 44.067 | 0.683 | 0 |
| 138 | Pressure-Side | 43.475 | 1.091 | 0 |
| 139 | Pressure-Side | 42.872 | 1.483 | 0 |
| 140 | Pressure-Side | 42.258 | 1.857 | 0 |
| 141 | Pressure-Side | 41.632 | 2.212 | 0 |
| 142 | Pressure-Side | 40.997 | 2.548 | 0 |
| 143 | Pressure-Side | 40.351 | 2.864 | 0 |
| 144 | Pressure-Side | 39.696 | 3.161 | 0 |
| 145 | Pressure-Side | 39.032 | 3.437 | 0 |
| 146 | Pressure-Side | 38.360 | 3.692 | 0 |
| 147 | Pressure-Side | 37.681 | 3.926 | 0 |
| 148 | Pressure-Side | 36.994 | 4.139 | 0 |
| 149 | Pressure-Side | 36.301 | 4.332 | 0 |
| 150 | Pressure-Side | 35.602 | 4.503 | 0 |
| 151 | Pressure-Side | 34.900 | 4.654 | 0 |
| 152 | Pressure-Side | 34.193 | 4.783 | 0 |
| 153 | Pressure-Side | 33.483 | 4.893 | 0 |
| 154 | Pressure-Side | 32.769 | 4.983 | 0 |
| 155 | Pressure-Side | 32.053 | 5.052 | 0 |
| 156 | Pressure-Side | 31.336 | 5.104 | 0 |
| 157 | Pressure-Side | 30.618 | 5.136 | 0 |
| 158 | Pressure-Side | 29.899 | 5.150 | 0 |
| 159 | Pressure-Side | 29.180 | 5.147 | 0 |
| 160 | Pressure-Side | 28.461 | 5.128 | 0 |
| 161 | Pressure-Side | 27.744 | 5.092 | 0 |
| 162 | Pressure-Side | 27.027 | 5.040 | 0 |
| 163 | Pressure-Side | 26.310 | 4.973 | 0 |
| 164 | Pressure-Side | 25.596 | 4.892 | 0 |
| 165 | Pressure-Side | 24.883 | 4.796 | 0 |
| 166 | Pressure-Side | 24.172 | 4.689 | 0 |
| 167 | Pressure-Side | 23.464 | 4.568 | 0 |
| 168 | Pressure-Side | 22.757 | 4.435 | 0 |
| 169 | Pressure-Side | 22.053 | 4.291 | 0 |
| 170 | Pressure-Side | 21.350 | 4.137 | 0 |
| 171 | Pressure-Side | 20.650 | 3.973 | 0 |
| 172 | Pressure-Side | 19.953 | 3.798 | 0 |
| 173 | Pressure-Side | 19.258 | 3.615 | 0 |
| 174 | Pressure-Side | 18.565 | 3.424 | 0 |
| 175 | Pressure-Side | 17.874 | 3.227 | 0 |
| 176 | Pressure-Side | 17.185 | 3.021 | 0 |
| 177 | Pressure-Side | 16.498 | 2.809 | 0 |
| 178 | Pressure-Side | 15.812 | 2.591 | 0 |

TABLE 1-continued

| N | Location | X | Y | Z |
|---|---|---|---|---|
| 179 | Pressure-Side | 15.129 | 2.369 | 0 |
| 180 | Pressure-Side | 14.446 | 2.143 | 0 |
| 181 | Pressure-Side | 13.765 | 1.912 | 0 |
| 182 | Pressure-Side | 13.085 | 1.680 | 0 |
| 183 | Pressure-Side | 12.405 | 1.445 | 0 |
| 184 | Pressure-Side | 11.726 | 1.210 | 0 |
| 185 | Pressure-Side | 11.046 | 0.975 | 0 |
| 186 | Pressure-Side | 10.366 | 0.742 | 0 |
| 187 | Pressure-Side | 9.685 | 0.512 | 0 |
| 188 | Pressure-Side | 9.001 | 0.288 | 0 |
| 189 | Pressure-Side | 8.317 | 0.071 | 0 |
| 190 | Pressure-Side | 7.628 | −0.138 | 0 |
| 191 | Pressure-Side | 6.936 | −0.333 | 0 |
| 192 | Pressure-Side | 6.240 | −0.511 | 0 |
| 193 | Pressure-Side | 5.538 | −0.668 | 0 |
| 194 | Pressure-Side | 4.831 | −0.797 | 0 |
| 195 | Pressure-Side | 4.118 | −0.890 | 0 |
| 196 | Pressure-Side | 3.401 | −0.936 | 0 |
| 197 | Pressure-Side | 2.682 | −0.924 | 0 |
| 198 | Pressure-Side | 1.969 | −0.834 | 0 |
| 199 | Pressure-Side | 1.273 | −0.656 | 0 |
| 200 | Pressure-Side | 0.611 | −0.377 | 0 |
| 1 | Suction-Side | 0.345 | −0.469 | 10 |
| 2 | Suction-Side | −0.424 | 0.311 | 10 |
| 3 | Suction-Side | −0.870 | 1.315 | 10 |
| 4 | Suction-Side | −1.072 | 2.396 | 10 |
| 5 | Suction-Side | −1.110 | 3.498 | 10 |
| 6 | Suction-Side | −1.031 | 4.598 | 10 |
| 7 | Suction-Side | −0.866 | 5.686 | 10 |
| 8 | Suction-Side | −0.632 | 6.764 | 10 |
| 9 | Suction-Side | −0.341 | 7.827 | 10 |
| 10 | Suction-Side | −0.002 | 8.876 | 10 |
| 11 | Suction-Side | 0.380 | 9.911 | 10 |
| 12 | Suction-Side | 0.799 | 10.930 | 10 |
| 13 | Suction-Side | 1.254 | 11.934 | 10 |
| 14 | Suction-Side | 1.740 | 12.924 | 10 |
| 15 | Suction-Side | 2.255 | 13.898 | 10 |
| 16 | Suction-Side | 2.799 | 14.856 | 10 |
| 17 | Suction-Side | 3.370 | 15.799 | 10 |
| 18 | Suction-Side | 3.968 | 16.726 | 10 |
| 19 | Suction-Side | 4.592 | 17.636 | 10 |
| 20 | Suction-Side | 5.239 | 18.528 | 10 |
| 21 | Suction-Side | 5.911 | 19.401 | 10 |
| 22 | Suction-Side | 6.609 | 20.256 | 10 |
| 23 | Suction-Side | 7.329 | 21.089 | 10 |
| 24 | Suction-Side | 8.074 | 21.902 | 10 |
| 25 | Suction-Side | 8.842 | 22.693 | 10 |
| 26 | Suction-Side | 9.634 | 23.459 | 10 |
| 27 | Suction-Side | 10.451 | 24.200 | 10 |
| 28 | Suction-Side | 11.291 | 24.913 | 10 |
| 29 | Suction-Side | 12.155 | 25.599 | 10 |
| 30 | Suction-Side | 13.043 | 26.252 | 10 |
| 31 | Suction-Side | 13.954 | 26.871 | 10 |
| 32 | Suction-Side | 14.889 | 27.456 | 10 |
| 33 | Suction-Side | 15.847 | 28.002 | 10 |
| 34 | Suction-Side | 16.828 | 28.506 | 10 |
| 35 | Suction-Side | 17.831 | 28.964 | 10 |
| 36 | Suction-Side | 18.853 | 29.374 | 10 |
| 37 | Suction-Side | 19.895 | 29.733 | 10 |
| 38 | Suction-Side | 20.955 | 30.036 | 10 |
| 39 | Suction-Side | 22.031 | 30.279 | 10 |
| 40 | Suction-Side | 23.118 | 30.459 | 10 |
| 41 | Suction-Side | 24.214 | 30.574 | 10 |
| 42 | Suction-Side | 25.316 | 30.621 | 10 |
| 43 | Suction-Side | 26.418 | 30.595 | 10 |
| 44 | Suction-Side | 27.515 | 30.496 | 10 |
| 45 | Suction-Side | 28.604 | 30.325 | 10 |
| 46 | Suction-Side | 29.679 | 30.082 | 10 |
| 47 | Suction-Side | 30.737 | 29.769 | 10 |
| 48 | Suction-Side | 31.771 | 29.389 | 10 |
| 49 | Suction-Side | 32.779 | 28.942 | 10 |
| 50 | Suction-Side | 33.759 | 28.437 | 10 |
| 51 | Suction-Side | 34.709 | 27.879 | 10 |
| 52 | Suction-Side | 35.626 | 27.267 | 10 |
| 53 | Suction-Side | 36.512 | 26.612 | 10 |
| 54 | Suction-Side | 37.366 | 25.914 | 10 |
| 55 | Suction-Side | 38.189 | 25.181 | 10 |
| 56 | Suction-Side | 38.981 | 24.414 | 10 |

TABLE 1-continued

| N | Location | X | Y | Z |
|---|---|---|---|---|
| 57 | Suction-Side | 39.744 | 23.620 | 10 |
| 58 | Suction-Side | 40.481 | 22.799 | 10 |
| 59 | Suction-Side | 41.191 | 21.954 | 10 |
| 60 | Suction-Side | 41.876 | 21.092 | 10 |
| 61 | Suction-Side | 42.538 | 20.210 | 10 |
| 62 | Suction-Side | 43.179 | 19.314 | 10 |
| 63 | Suction-Side | 43.801 | 18.402 | 10 |
| 64 | Suction-Side | 44.403 | 17.480 | 10 |
| 65 | Suction-Side | 44.989 | 16.546 | 10 |
| 66 | Suction-Side | 45.559 | 15.602 | 10 |
| 67 | Suction-Side | 46.114 | 14.649 | 10 |
| 68 | Suction-Side | 46.654 | 13.689 | 10 |
| 69 | Suction-Side | 47.183 | 12.721 | 10 |
| 70 | Suction-Side | 47.699 | 11.747 | 10 |
| 71 | Suction-Side | 48.205 | 10.767 | 10 |
| 72 | Suction-Side | 48.700 | 9.783 | 10 |
| 73 | Suction-Side | 49.186 | 8.792 | 10 |
| 74 | Suction-Side | 49.662 | 7.798 | 10 |
| 75 | Suction-Side | 50.130 | 6.800 | 10 |
| 76 | Suction-Side | 50.590 | 5.799 | 10 |
| 77 | Suction-Side | 51.044 | 4.794 | 10 |
| 78 | Suction-Side | 51.489 | 3.785 | 10 |
| 79 | Suction-Side | 51.928 | 2.774 | 10 |
| 80 | Suction-Side | 52.361 | 1.760 | 10 |
| 81 | Suction-Side | 52.788 | 0.743 | 10 |
| 82 | Suction-Side | 53.208 | −0.275 | 10 |
| 83 | Suction-Side | 53.622 | −1.297 | 10 |
| 84 | Suction-Side | 54.031 | −2.321 | 10 |
| 85 | Suction-Side | 54.436 | −3.346 | 10 |
| 86 | Suction-Side | 54.836 | −4.374 | 10 |
| 87 | Suction-Side | 55.232 | −5.403 | 10 |
| 88 | Suction-Side | 55.627 | −6.432 | 10 |
| 89 | Suction-Side | 56.018 | −7.463 | 10 |
| 90 | Suction-Side | 56.407 | −8.494 | 10 |
| 91 | Suction-Side | 56.794 | −9.527 | 10 |
| 92 | Suction-Side | 57.176 | −10.560 | 10 |
| 93 | Suction-Side | 57.557 | −11.595 | 10 |
| 94 | Suction-Side | 57.934 | −12.631 | 10 |
| 95 | Suction-Side | 58.308 | −13.668 | 10 |
| 96 | Suction-Side | 58.678 | −14.707 | 10 |
| 97 | Suction-Side | 59.046 | −15.746 | 10 |
| 98 | Suction-Side | 59.410 | −16.786 | 10 |
| 99 | Suction-Side | 59.771 | −17.828 | 10 |
| 100 | Suction-Side | 59.977 | −18.895 | 10 |
| 101 | Pressure-Side | 59.286 | −19.697 | 10 |
| 102 | Pressure-Side | 58.576 | −19.759 | 10 |
| 103 | Pressure-Side | 57.983 | −19.370 | 10 |
| 104 | Pressure-Side | 57.650 | −18.728 | 10 |
| 105 | Pressure-Side | 57.343 | −18.072 | 10 |
| 106 | Pressure-Side | 57.034 | −17.417 | 10 |
| 107 | Pressure-Side | 56.724 | −16.762 | 10 |
| 108 | Pressure-Side | 56.412 | −16.108 | 10 |
| 109 | Pressure-Side | 56.099 | −15.456 | 10 |
| 110 | Pressure-Side | 55.781 | −14.804 | 10 |
| 111 | Pressure-Side | 55.461 | −14.154 | 10 |
| 112 | Pressure-Side | 55.137 | −13.507 | 10 |
| 113 | Pressure-Side | 54.809 | −12.861 | 10 |
| 114 | Pressure-Side | 54.475 | −12.218 | 10 |
| 115 | Pressure-Side | 54.136 | −11.578 | 10 |
| 116 | Pressure-Side | 53.793 | −10.941 | 10 |
| 117 | Pressure-Side | 53.443 | −10.307 | 10 |
| 118 | Pressure-Side | 53.085 | −9.676 | 10 |
| 119 | Pressure-Side | 52.721 | −9.050 | 10 |
| 120 | Pressure-Side | 52.350 | −8.428 | 10 |
| 121 | Pressure-Side | 51.970 | −7.811 | 10 |
| 122 | Pressure-Side | 51.582 | −7.200 | 10 |
| 123 | Pressure-Side | 51.185 | −6.594 | 10 |
| 124 | Pressure-Side | 50.780 | −5.994 | 10 |
| 125 | Pressure-Side | 50.363 | −5.402 | 10 |
| 126 | Pressure-Side | 49.936 | −4.817 | 10 |
| 127 | Pressure-Side | 49.499 | −4.239 | 10 |
| 128 | Pressure-Side | 49.050 | −3.670 | 10 |
| 129 | Pressure-Side | 48.589 | −3.112 | 10 |
| 130 | Pressure-Side | 48.115 | −2.564 | 10 |
| 131 | Pressure-Side | 47.629 | −2.027 | 10 |
| 132 | Pressure-Side | 47.132 | −1.501 | 10 |
| 133 | Pressure-Side | 46.620 | −0.988 | 10 |
| 134 | Pressure-Side | 46.095 | −0.489 | 10 |

TABLE 1-continued

| N | Location | X | Y | Z |
|---|---|---|---|---|
| 135 | Pressure-Side | 45.557 | −0.004 | 10 |
| 136 | Pressure-Side | 45.006 | 0.467 | 10 |
| 137 | Pressure-Side | 44.442 | 0.920 | 10 |
| 138 | Pressure-Side | 43.865 | 1.358 | 10 |
| 139 | Pressure-Side | 43.274 | 1.777 | 10 |
| 140 | Pressure-Side | 42.671 | 2.179 | 10 |
| 141 | Pressure-Side | 42.056 | 2.560 | 10 |
| 142 | Pressure-Side | 41.428 | 2.922 | 10 |
| 143 | Pressure-Side | 40.789 | 3.262 | 10 |
| 144 | Pressure-Side | 40.139 | 3.581 | 10 |
| 145 | Pressure-Side | 39.477 | 3.879 | 10 |
| 146 | Pressure-Side | 38.808 | 4.154 | 10 |
| 147 | Pressure-Side | 38.129 | 4.406 | 10 |
| 148 | Pressure-Side | 37.442 | 4.636 | 10 |
| 149 | Pressure-Side | 36.749 | 4.843 | 10 |
| 150 | Pressure-Side | 36.048 | 5.027 | 10 |
| 151 | Pressure-Side | 35.342 | 5.190 | 10 |
| 152 | Pressure-Side | 34.631 | 5.330 | 10 |
| 153 | Pressure-Side | 33.917 | 5.447 | 10 |
| 154 | Pressure-Side | 33.199 | 5.545 | 10 |
| 155 | Pressure-Side | 32.479 | 5.622 | 10 |
| 156 | Pressure-Side | 31.756 | 5.678 | 10 |
| 157 | Pressure-Side | 31.034 | 5.715 | 10 |
| 158 | Pressure-Side | 30.309 | 5.733 | 10 |
| 159 | Pressure-Side | 29.585 | 5.733 | 10 |
| 160 | Pressure-Side | 28.861 | 5.716 | 10 |
| 161 | Pressure-Side | 28.137 | 5.682 | 10 |
| 162 | Pressure-Side | 27.415 | 5.631 | 10 |
| 163 | Pressure-Side | 26.693 | 5.567 | 10 |
| 164 | Pressure-Side | 25.973 | 5.487 | 10 |
| 165 | Pressure-Side | 25.255 | 5.392 | 10 |
| 166 | Pressure-Side | 24.539 | 5.284 | 10 |
| 167 | Pressure-Side | 23.824 | 5.163 | 10 |
| 168 | Pressure-Side | 23.112 | 5.031 | 10 |
| 169 | Pressure-Side | 22.403 | 4.886 | 10 |
| 170 | Pressure-Side | 21.696 | 4.729 | 10 |
| 171 | Pressure-Side | 20.991 | 4.563 | 10 |
| 172 | Pressure-Side | 20.289 | 4.386 | 10 |
| 173 | Pressure-Side | 19.589 | 4.199 | 10 |
| 174 | Pressure-Side | 18.892 | 4.004 | 10 |
| 175 | Pressure-Side | 18.197 | 3.800 | 10 |
| 176 | Pressure-Side | 17.504 | 3.587 | 10 |
| 177 | Pressure-Side | 16.815 | 3.367 | 10 |
| 178 | Pressure-Side | 16.127 | 3.138 | 10 |
| 179 | Pressure-Side | 15.441 | 2.904 | 10 |
| 180 | Pressure-Side | 14.758 | 2.662 | 10 |
| 181 | Pressure-Side | 14.078 | 2.415 | 10 |
| 182 | Pressure-Side | 13.398 | 2.164 | 10 |
| 183 | Pressure-Side | 12.721 | 1.908 | 10 |
| 184 | Pressure-Side | 12.044 | 1.649 | 10 |
| 185 | Pressure-Side | 11.369 | 1.387 | 10 |
| 186 | Pressure-Side | 10.694 | 1.123 | 10 |
| 187 | Pressure-Side | 10.020 | 0.860 | 10 |
| 188 | Pressure-Side | 9.345 | 0.597 | 10 |
| 189 | Pressure-Side | 8.669 | 0.336 | 10 |
| 190 | Pressure-Side | 7.990 | 0.081 | 10 |
| 191 | Pressure-Side | 7.310 | −0.166 | 10 |
| 192 | Pressure-Side | 6.625 | −0.402 | 10 |
| 193 | Pressure-Side | 5.936 | −0.623 | 10 |
| 194 | Pressure-Side | 5.239 | −0.822 | 10 |
| 195 | Pressure-Side | 4.535 | −0.991 | 10 |
| 196 | Pressure-Side | 3.822 | −1.116 | 10 |
| 197 | Pressure-Side | 3.101 | −1.183 | 10 |
| 198 | Pressure-Side | 2.377 | −1.169 | 10 |
| 199 | Pressure-Side | 1.663 | −1.052 | 10 |
| 200 | Pressure-Side | 0.979 | −0.816 | 10 |
| 1 | Suction-Side | 0.774 | −0.195 | 20 |
| 2 | Suction-Side | −0.018 | 0.581 | 20 |
| 3 | Suction-Side | −0.483 | 1.595 | 20 |
| 4 | Suction-Side | −0.712 | 2.688 | 20 |
| 5 | Suction-Side | −0.781 | 3.804 | 20 |
| 6 | Suction-Side | −0.737 | 4.922 | 20 |
| 7 | Suction-Side | −0.605 | 6.033 | 20 |
| 8 | Suction-Side | −0.406 | 7.134 | 20 |
| 9 | Suction-Side | −0.147 | 8.221 | 20 |
| 10 | Suction-Side | 0.160 | 9.298 | 20 |
| 11 | Suction-Side | 0.512 | 10.359 | 20 |
| 12 | Suction-Side | 0.903 | 11.407 | 20 |

TABLE 1-continued

| N | Location | X | Y | Z |
|---|---|---|---|---|
| 13 | Suction-Side | 1.332 | 12.441 | 20 |
| 14 | Suction-Side | 1.793 | 13.460 | 20 |
| 15 | Suction-Side | 2.287 | 14.464 | 20 |
| 16 | Suction-Side | 2.811 | 15.452 | 20 |
| 17 | Suction-Side | 3.365 | 16.425 | 20 |
| 18 | Suction-Side | 3.948 | 17.380 | 20 |
| 19 | Suction-Side | 4.558 | 18.317 | 20 |
| 20 | Suction-Side | 5.196 | 19.237 | 20 |
| 21 | Suction-Side | 5.860 | 20.137 | 20 |
| 22 | Suction-Side | 6.551 | 21.018 | 20 |
| 23 | Suction-Side | 7.268 | 21.875 | 20 |
| 24 | Suction-Side | 8.012 | 22.712 | 20 |
| 25 | Suction-Side | 8.781 | 23.524 | 20 |
| 26 | Suction-Side | 9.576 | 24.311 | 20 |
| 27 | Suction-Side | 10.398 | 25.071 | 20 |
| 28 | Suction-Side | 11.245 | 25.802 | 20 |
| 29 | Suction-Side | 12.117 | 26.502 | 20 |
| 30 | Suction-Side | 13.015 | 27.169 | 20 |
| 31 | Suction-Side | 13.939 | 27.800 | 20 |
| 32 | Suction-Side | 14.888 | 28.393 | 20 |
| 33 | Suction-Side | 15.860 | 28.946 | 20 |
| 34 | Suction-Side | 16.857 | 29.454 | 20 |
| 35 | Suction-Side | 17.876 | 29.916 | 20 |
| 36 | Suction-Side | 18.917 | 30.327 | 20 |
| 37 | Suction-Side | 19.977 | 30.683 | 20 |
| 38 | Suction-Side | 21.055 | 30.982 | 20 |
| 39 | Suction-Side | 22.148 | 31.220 | 20 |
| 40 | Suction-Side | 23.252 | 31.394 | 20 |
| 41 | Suction-Side | 24.366 | 31.500 | 20 |
| 42 | Suction-Side | 25.485 | 31.536 | 20 |
| 43 | Suction-Side | 26.602 | 31.498 | 20 |
| 44 | Suction-Side | 27.716 | 31.387 | 20 |
| 45 | Suction-Side | 28.819 | 31.200 | 20 |
| 46 | Suction-Side | 29.907 | 30.940 | 20 |
| 47 | Suction-Side | 30.975 | 30.609 | 20 |
| 48 | Suction-Side | 32.019 | 30.207 | 20 |
| 49 | Suction-Side | 33.035 | 29.739 | 20 |
| 50 | Suction-Side | 34.021 | 29.210 | 20 |
| 51 | Suction-Side | 34.974 | 28.625 | 20 |
| 52 | Suction-Side | 35.893 | 27.986 | 20 |
| 53 | Suction-Side | 36.777 | 27.302 | 20 |
| 54 | Suction-Side | 37.628 | 26.575 | 20 |
| 55 | Suction-Side | 38.444 | 25.810 | 20 |
| 56 | Suction-Side | 39.229 | 25.012 | 20 |
| 57 | Suction-Side | 39.981 | 24.184 | 20 |
| 58 | Suction-Side | 40.705 | 23.331 | 20 |
| 59 | Suction-Side | 41.401 | 22.456 | 20 |
| 60 | Suction-Side | 42.072 | 21.560 | 20 |
| 61 | Suction-Side | 42.718 | 20.647 | 20 |
| 62 | Suction-Side | 43.344 | 19.718 | 20 |
| 63 | Suction-Side | 43.947 | 18.777 | 20 |
| 64 | Suction-Side | 44.533 | 17.823 | 20 |
| 65 | Suction-Side | 45.100 | 16.860 | 20 |
| 66 | Suction-Side | 45.653 | 15.886 | 20 |
| 67 | Suction-Side | 46.190 | 14.905 | 20 |
| 68 | Suction-Side | 46.715 | 13.917 | 20 |
| 69 | Suction-Side | 47.226 | 12.922 | 20 |
| 70 | Suction-Side | 47.728 | 11.922 | 20 |
| 71 | Suction-Side | 48.218 | 10.916 | 20 |
| 72 | Suction-Side | 48.698 | 9.906 | 20 |
| 73 | Suction-Side | 49.169 | 8.891 | 20 |
| 74 | Suction-Side | 49.632 | 7.872 | 20 |
| 75 | Suction-Side | 50.088 | 6.850 | 20 |
| 76 | Suction-Side | 50.537 | 5.825 | 20 |
| 77 | Suction-Side | 50.978 | 4.797 | 20 |
| 78 | Suction-Side | 51.412 | 3.766 | 20 |
| 79 | Suction-Side | 51.841 | 2.732 | 20 |
| 80 | Suction-Side | 52.263 | 1.696 | 20 |
| 81 | Suction-Side | 52.679 | 0.658 | 20 |
| 82 | Suction-Side | 53.090 | −0.383 | 20 |
| 83 | Suction-Side | 53.495 | −1.426 | 20 |
| 84 | Suction-Side | 53.894 | −2.470 | 20 |
| 85 | Suction-Side | 54.288 | −3.517 | 20 |
| 86 | Suction-Side | 54.680 | −4.567 | 20 |
| 87 | Suction-Side | 55.066 | −5.616 | 20 |
| 88 | Suction-Side | 55.451 | −6.667 | 20 |
| 89 | Suction-Side | 55.833 | −7.719 | 20 |
| 90 | Suction-Side | 56.212 | −8.771 | 20 |

TABLE 1-continued

| N | Location | X | Y | Z |
|---|---|---|---|---|
| 91 | Suction-Side | 56.588 | −9.825 | 20 |
| 92 | Suction-Side | 56.961 | −10.880 | 20 |
| 93 | Suction-Side | 57.332 | −11.935 | 20 |
| 94 | Suction-Side | 57.699 | −12.992 | 20 |
| 95 | Suction-Side | 58.063 | −14.050 | 20 |
| 96 | Suction-Side | 58.424 | −15.109 | 20 |
| 97 | Suction-Side | 58.782 | −16.169 | 20 |
| 98 | Suction-Side | 59.138 | −17.230 | 20 |
| 99 | Suction-Side | 59.491 | −18.291 | 20 |
| 100 | Suction-Side | 59.698 | −19.375 | 20 |
| 101 | Pressure-Side | 58.994 | −20.184 | 20 |
| 102 | Pressure-Side | 58.278 | −20.235 | 20 |
| 103 | Pressure-Side | 57.691 | −19.830 | 20 |
| 104 | Pressure-Side | 57.369 | −19.176 | 20 |
| 105 | Pressure-Side | 57.070 | −18.512 | 20 |
| 106 | Pressure-Side | 56.770 | −17.847 | 20 |
| 107 | Pressure-Side | 56.471 | −17.183 | 20 |
| 108 | Pressure-Side | 56.169 | −16.521 | 20 |
| 109 | Pressure-Side | 55.865 | −15.858 | 20 |
| 110 | Pressure-Side | 55.560 | −15.195 | 20 |
| 111 | Pressure-Side | 55.253 | −14.535 | 20 |
| 112 | Pressure-Side | 54.942 | −13.875 | 20 |
| 113 | Pressure-Side | 54.627 | −13.217 | 20 |
| 114 | Pressure-Side | 54.309 | −12.563 | 20 |
| 115 | Pressure-Side | 53.986 | −11.909 | 20 |
| 116 | Pressure-Side | 53.658 | −11.258 | 20 |
| 117 | Pressure-Side | 53.324 | −10.609 | 20 |
| 118 | Pressure-Side | 52.986 | −9.964 | 20 |
| 119 | Pressure-Side | 52.640 | −9.323 | 20 |
| 120 | Pressure-Side | 52.288 | −8.684 | 20 |
| 121 | Pressure-Side | 51.929 | −8.050 | 20 |
| 122 | Pressure-Side | 51.562 | −7.420 | 20 |
| 123 | Pressure-Side | 51.186 | −6.795 | 20 |
| 124 | Pressure-Side | 50.802 | −6.176 | 20 |
| 125 | Pressure-Side | 50.409 | −5.563 | 20 |
| 126 | Pressure-Side | 50.005 | −4.955 | 20 |
| 127 | Pressure-Side | 49.592 | −4.356 | 20 |
| 128 | Pressure-Side | 49.166 | −3.764 | 20 |
| 129 | Pressure-Side | 48.729 | −3.181 | 20 |
| 130 | Pressure-Side | 48.280 | −2.607 | 20 |
| 131 | Pressure-Side | 47.819 | −2.042 | 20 |
| 132 | Pressure-Side | 47.344 | −1.489 | 20 |
| 133 | Pressure-Side | 46.855 | −0.948 | 20 |
| 134 | Pressure-Side | 46.354 | −0.419 | 20 |
| 135 | Pressure-Side | 45.839 | 0.097 | 20 |
| 136 | Pressure-Side | 45.310 | 0.598 | 20 |
| 137 | Pressure-Side | 44.767 | 1.084 | 20 |
| 138 | Pressure-Side | 44.210 | 1.554 | 20 |
| 139 | Pressure-Side | 43.638 | 2.006 | 20 |
| 140 | Pressure-Side | 43.053 | 2.441 | 20 |
| 141 | Pressure-Side | 42.455 | 2.857 | 20 |
| 142 | Pressure-Side | 41.843 | 3.252 | 20 |
| 143 | Pressure-Side | 41.217 | 3.627 | 20 |
| 144 | Pressure-Side | 40.579 | 3.980 | 20 |
| 145 | Pressure-Side | 39.931 | 4.310 | 20 |
| 146 | Pressure-Side | 39.271 | 4.619 | 20 |
| 147 | Pressure-Side | 38.599 | 4.904 | 20 |
| 148 | Pressure-Side | 37.919 | 5.166 | 20 |
| 149 | Pressure-Side | 37.231 | 5.404 | 20 |
| 150 | Pressure-Side | 36.533 | 5.619 | 20 |
| 151 | Pressure-Side | 35.831 | 5.811 | 20 |
| 152 | Pressure-Side | 35.122 | 5.978 | 20 |
| 153 | Pressure-Side | 34.407 | 6.124 | 20 |
| 154 | Pressure-Side | 33.688 | 6.247 | 20 |
| 155 | Pressure-Side | 32.967 | 6.348 | 20 |
| 156 | Pressure-Side | 32.243 | 6.428 | 20 |
| 157 | Pressure-Side | 31.516 | 6.488 | 20 |
| 158 | Pressure-Side | 30.788 | 6.527 | 20 |
| 159 | Pressure-Side | 30.060 | 6.548 | 20 |
| 160 | Pressure-Side | 29.331 | 6.549 | 20 |
| 161 | Pressure-Side | 28.603 | 6.533 | 20 |
| 162 | Pressure-Side | 27.874 | 6.499 | 20 |
| 163 | Pressure-Side | 27.147 | 6.448 | 20 |
| 164 | Pressure-Side | 26.422 | 6.383 | 20 |
| 165 | Pressure-Side | 25.697 | 6.300 | 20 |
| 166 | Pressure-Side | 24.975 | 6.203 | 20 |
| 167 | Pressure-Side | 24.254 | 6.092 | 20 |
| 168 | Pressure-Side | 23.536 | 5.967 | 20 |

TABLE 1-continued

| N | Location | X | Y | Z |
|---|---|---|---|---|
| 169 | Pressure-Side | 22.821 | 5.829 | 20 |
| 170 | Pressure-Side | 22.108 | 5.678 | 20 |
| 171 | Pressure-Side | 21.397 | 5.515 | 20 |
| 172 | Pressure-Side | 20.690 | 5.341 | 20 |
| 173 | Pressure-Side | 19.985 | 5.154 | 20 |
| 174 | Pressure-Side | 19.283 | 4.958 | 20 |
| 175 | Pressure-Side | 18.584 | 4.751 | 20 |
| 176 | Pressure-Side | 17.888 | 4.533 | 20 |
| 177 | Pressure-Side | 17.195 | 4.307 | 20 |
| 178 | Pressure-Side | 16.506 | 4.071 | 20 |
| 179 | Pressure-Side | 15.819 | 3.826 | 20 |
| 180 | Pressure-Side | 15.135 | 3.575 | 20 |
| 181 | Pressure-Side | 14.454 | 3.314 | 20 |
| 182 | Pressure-Side | 13.776 | 3.047 | 20 |
| 183 | Pressure-Side | 13.100 | 2.774 | 20 |
| 184 | Pressure-Side | 12.427 | 2.496 | 20 |
| 185 | Pressure-Side | 11.755 | 2.212 | 20 |
| 186 | Pressure-Side | 11.085 | 1.925 | 20 |
| 187 | Pressure-Side | 10.417 | 1.635 | 20 |
| 188 | Pressure-Side | 9.748 | 1.345 | 20 |
| 189 | Pressure-Side | 9.080 | 1.054 | 20 |
| 190 | Pressure-Side | 8.410 | 0.766 | 20 |
| 191 | Pressure-Side | 7.739 | 0.482 | 20 |
| 192 | Pressure-Side | 7.065 | 0.207 | 20 |
| 193 | Pressure-Side | 6.384 | −0.055 | 20 |
| 194 | Pressure-Side | 5.697 | −0.297 | 20 |
| 195 | Pressure-Side | 5.000 | −0.511 | 20 |
| 196 | Pressure-Side | 4.291 | −0.682 | 20 |
| 197 | Pressure-Side | 3.571 | −0.793 | 20 |
| 198 | Pressure-Side | 2.844 | −0.821 | 20 |
| 199 | Pressure-Side | 2.121 | −0.736 | 20 |
| 200 | Pressure-Side | 1.424 | −0.524 | 20 |
| 1 | Suction-Side | 1.357 | 1.322 | 30 |
| 2 | Suction-Side | 0.586 | 2.108 | 30 |
| 3 | Suction-Side | 0.172 | 3.137 | 30 |
| 4 | Suction-Side | −0.007 | 4.234 | 30 |
| 5 | Suction-Side | −0.032 | 5.347 | 30 |
| 6 | Suction-Side | 0.049 | 6.456 | 30 |
| 7 | Suction-Side | 0.214 | 7.556 | 30 |
| 8 | Suction-Side | 0.446 | 8.644 | 30 |
| 9 | Suction-Side | 0.733 | 9.719 | 30 |
| 10 | Suction-Side | 1.070 | 10.780 | 30 |
| 11 | Suction-Side | 1.448 | 11.826 | 30 |
| 12 | Suction-Side | 1.864 | 12.858 | 30 |
| 13 | Suction-Side | 2.316 | 13.875 | 30 |
| 14 | Suction-Side | 2.801 | 14.877 | 30 |
| 15 | Suction-Side | 3.316 | 15.864 | 30 |
| 16 | Suction-Side | 3.861 | 16.834 | 30 |
| 17 | Suction-Side | 4.434 | 17.787 | 30 |
| 18 | Suction-Side | 5.034 | 18.725 | 30 |
| 19 | Suction-Side | 5.660 | 19.644 | 30 |
| 20 | Suction-Side | 6.313 | 20.546 | 30 |
| 21 | Suction-Side | 6.992 | 21.428 | 30 |
| 22 | Suction-Side | 7.694 | 22.291 | 30 |
| 23 | Suction-Side | 8.422 | 23.132 | 30 |
| 24 | Suction-Side | 9.176 | 23.951 | 30 |
| 25 | Suction-Side | 9.954 | 24.747 | 30 |
| 26 | Suction-Side | 10.756 | 25.517 | 30 |
| 27 | Suction-Side | 11.584 | 26.260 | 30 |
| 28 | Suction-Side | 12.437 | 26.976 | 30 |
| 29 | Suction-Side | 13.315 | 27.659 | 30 |
| 30 | Suction-Side | 14.220 | 28.308 | 30 |
| 31 | Suction-Side | 15.148 | 28.921 | 30 |
| 32 | Suction-Side | 16.102 | 29.495 | 30 |
| 33 | Suction-Side | 17.079 | 30.025 | 30 |
| 34 | Suction-Side | 18.082 | 30.508 | 30 |
| 35 | Suction-Side | 19.107 | 30.941 | 30 |
| 36 | Suction-Side | 20.154 | 31.320 | 30 |
| 37 | Suction-Side | 21.220 | 31.639 | 30 |
| 38 | Suction-Side | 22.303 | 31.894 | 30 |
| 39 | Suction-Side | 23.400 | 32.082 | 30 |
| 40 | Suction-Side | 24.506 | 32.196 | 30 |
| 41 | Suction-Side | 25.618 | 32.238 | 30 |
| 42 | Suction-Side | 26.730 | 32.204 | 30 |
| 43 | Suction-Side | 27.837 | 32.091 | 30 |
| 44 | Suction-Side | 28.933 | 31.900 | 30 |
| 45 | Suction-Side | 30.013 | 31.633 | 30 |
| 46 | Suction-Side | 31.072 | 31.292 | 30 |

TABLE 1-continued

| N | Location | X | Y | Z |
|---|---|---|---|---|
| 47 | Suction-Side | 32.106 | 30.880 | 30 |
| 48 | Suction-Side | 33.110 | 30.402 | 30 |
| 49 | Suction-Side | 34.082 | 29.861 | 30 |
| 50 | Suction-Side | 35.021 | 29.264 | 30 |
| 51 | Suction-Side | 35.925 | 28.616 | 30 |
| 52 | Suction-Side | 36.794 | 27.921 | 30 |
| 53 | Suction-Side | 37.628 | 27.184 | 30 |
| 54 | Suction-Side | 38.428 | 26.410 | 30 |
| 55 | Suction-Side | 39.195 | 25.603 | 30 |
| 56 | Suction-Side | 39.931 | 24.769 | 30 |
| 57 | Suction-Side | 40.638 | 23.909 | 30 |
| 58 | Suction-Side | 41.316 | 23.028 | 30 |
| 59 | Suction-Side | 41.970 | 22.127 | 30 |
| 60 | Suction-Side | 42.598 | 21.208 | 30 |
| 61 | Suction-Side | 43.205 | 20.276 | 30 |
| 62 | Suction-Side | 43.792 | 19.330 | 30 |
| 63 | Suction-Side | 44.359 | 18.373 | 30 |
| 64 | Suction-Side | 44.909 | 17.405 | 30 |
| 65 | Suction-Side | 45.444 | 16.430 | 30 |
| 66 | Suction-Side | 45.964 | 15.445 | 30 |
| 67 | Suction-Side | 46.471 | 14.454 | 30 |
| 68 | Suction-Side | 46.966 | 13.458 | 30 |
| 69 | Suction-Side | 47.450 | 12.455 | 30 |
| 70 | Suction-Side | 47.924 | 11.449 | 30 |
| 71 | Suction-Side | 48.388 | 10.437 | 30 |
| 72 | Suction-Side | 48.843 | 9.423 | 30 |
| 73 | Suction-Side | 49.290 | 8.403 | 30 |
| 74 | Suction-Side | 49.730 | 7.382 | 30 |
| 75 | Suction-Side | 50.163 | 6.356 | 30 |
| 76 | Suction-Side | 50.589 | 5.329 | 30 |
| 77 | Suction-Side | 51.010 | 4.297 | 30 |
| 78 | Suction-Side | 51.424 | 3.265 | 30 |
| 79 | Suction-Side | 51.833 | 2.230 | 30 |
| 80 | Suction-Side | 52.237 | 1.193 | 30 |
| 81 | Suction-Side | 52.635 | 0.153 | 30 |
| 82 | Suction-Side | 53.027 | −0.888 | 30 |
| 83 | Suction-Side | 53.414 | −1.931 | 30 |
| 84 | Suction-Side | 53.797 | −2.977 | 30 |
| 85 | Suction-Side | 54.175 | −4.023 | 30 |
| 86 | Suction-Side | 54.549 | −5.071 | 30 |
| 87 | Suction-Side | 54.920 | −6.121 | 30 |
| 88 | Suction-Side | 55.289 | −7.170 | 30 |
| 89 | Suction-Side | 55.655 | −8.221 | 30 |
| 90 | Suction-Side | 56.017 | −9.273 | 30 |
| 91 | Suction-Side | 56.378 | −10.326 | 30 |
| 92 | Suction-Side | 56.737 | −11.380 | 30 |
| 93 | Suction-Side | 57.091 | −12.434 | 30 |
| 94 | Suction-Side | 57.444 | −13.489 | 30 |
| 95 | Suction-Side | 57.794 | −14.547 | 30 |
| 96 | Suction-Side | 58.140 | −15.604 | 30 |
| 97 | Suction-Side | 58.483 | −16.662 | 30 |
| 98 | Suction-Side | 58.824 | −17.722 | 30 |
| 99 | Suction-Side | 59.162 | −18.782 | 30 |
| 100 | Suction-Side | 59.362 | −19.862 | 30 |
| 101 | Pressure-Side | 58.656 | −20.661 | 30 |
| 102 | Pressure-Side | 57.934 | −20.699 | 30 |
| 103 | Pressure-Side | 57.355 | −20.270 | 30 |
| 104 | Pressure-Side | 57.041 | −19.604 | 30 |
| 105 | Pressure-Side | 56.745 | −18.929 | 30 |
| 106 | Pressure-Side | 56.449 | −18.254 | 30 |
| 107 | Pressure-Side | 56.154 | −17.579 | 30 |
| 108 | Pressure-Side | 55.858 | −16.905 | 30 |
| 109 | Pressure-Side | 55.563 | −16.230 | 30 |
| 110 | Pressure-Side | 55.265 | −15.556 | 30 |
| 111 | Pressure-Side | 54.966 | −14.883 | 30 |
| 112 | Pressure-Side | 54.664 | −14.210 | 30 |
| 113 | Pressure-Side | 54.361 | −13.539 | 30 |
| 114 | Pressure-Side | 54.054 | −12.869 | 30 |
| 115 | Pressure-Side | 53.744 | −12.202 | 30 |
| 116 | Pressure-Side | 53.431 | −11.535 | 30 |
| 117 | Pressure-Side | 53.112 | −10.870 | 30 |
| 118 | Pressure-Side | 52.789 | −10.209 | 30 |
| 119 | Pressure-Side | 52.462 | −9.548 | 30 |
| 120 | Pressure-Side | 52.129 | −8.891 | 30 |
| 121 | Pressure-Side | 51.789 | −8.238 | 30 |
| 122 | Pressure-Side | 51.443 | −7.587 | 30 |
| 123 | Pressure-Side | 51.091 | −6.941 | 30 |
| 124 | Pressure-Side | 50.729 | −6.299 | 30 |

TABLE 1-continued

| N | Location | X | Y | Z |
|---|---|---|---|---|
| 125 | Pressure-Side | 50.361 | −5.661 | 30 |
| 126 | Pressure-Side | 49.983 | −5.028 | 30 |
| 127 | Pressure-Side | 49.595 | −4.401 | 30 |
| 128 | Pressure-Side | 49.198 | −3.782 | 30 |
| 129 | Pressure-Side | 48.790 | −3.168 | 30 |
| 130 | Pressure-Side | 48.371 | −2.563 | 30 |
| 131 | Pressure-Side | 47.941 | −1.964 | 30 |
| 132 | Pressure-Side | 47.498 | −1.376 | 30 |
| 133 | Pressure-Side | 47.043 | −0.797 | 30 |
| 134 | Pressure-Side | 46.575 | −0.227 | 30 |
| 135 | Pressure-Side | 46.095 | 0.331 | 30 |
| 136 | Pressure-Side | 45.600 | 0.877 | 30 |
| 137 | Pressure-Side | 45.092 | 1.411 | 30 |
| 138 | Pressure-Side | 44.570 | 1.931 | 30 |
| 139 | Pressure-Side | 44.034 | 2.437 | 30 |
| 140 | Pressure-Side | 43.484 | 2.926 | 30 |
| 141 | Pressure-Side | 42.921 | 3.400 | 30 |
| 142 | Pressure-Side | 42.342 | 3.856 | 30 |
| 143 | Pressure-Side | 41.749 | 4.294 | 30 |
| 144 | Pressure-Side | 41.143 | 4.712 | 30 |
| 145 | Pressure-Side | 40.523 | 5.110 | 30 |
| 146 | Pressure-Side | 39.890 | 5.487 | 30 |
| 147 | Pressure-Side | 39.244 | 5.842 | 30 |
| 148 | Pressure-Side | 38.587 | 6.174 | 30 |
| 149 | Pressure-Side | 37.919 | 6.484 | 30 |
| 150 | Pressure-Side | 37.240 | 6.770 | 30 |
| 151 | Pressure-Side | 36.551 | 7.032 | 30 |
| 152 | Pressure-Side | 35.854 | 7.270 | 30 |
| 153 | Pressure-Side | 35.149 | 7.483 | 30 |
| 154 | Pressure-Side | 34.437 | 7.672 | 30 |
| 155 | Pressure-Side | 33.719 | 7.837 | 30 |
| 156 | Pressure-Side | 32.996 | 7.976 | 30 |
| 157 | Pressure-Side | 32.268 | 8.092 | 30 |
| 158 | Pressure-Side | 31.537 | 8.184 | 30 |
| 159 | Pressure-Side | 30.804 | 8.251 | 30 |
| 160 | Pressure-Side | 30.068 | 8.296 | 30 |
| 161 | Pressure-Side | 29.332 | 8.317 | 30 |
| 162 | Pressure-Side | 28.595 | 8.316 | 30 |
| 163 | Pressure-Side | 27.860 | 8.293 | 30 |
| 164 | Pressure-Side | 27.124 | 8.249 | 30 |
| 165 | Pressure-Side | 26.391 | 8.184 | 30 |
| 166 | Pressure-Side | 25.658 | 8.099 | 30 |
| 167 | Pressure-Side | 24.929 | 7.996 | 30 |
| 168 | Pressure-Side | 24.202 | 7.874 | 30 |
| 169 | Pressure-Side | 23.479 | 7.736 | 30 |
| 170 | Pressure-Side | 22.758 | 7.580 | 30 |
| 171 | Pressure-Side | 22.042 | 7.409 | 30 |
| 172 | Pressure-Side | 21.330 | 7.224 | 30 |
| 173 | Pressure-Side | 20.620 | 7.023 | 30 |
| 174 | Pressure-Side | 19.916 | 6.808 | 30 |
| 175 | Pressure-Side | 19.215 | 6.581 | 30 |
| 176 | Pressure-Side | 18.518 | 6.342 | 30 |
| 177 | Pressure-Side | 17.826 | 6.092 | 30 |
| 178 | Pressure-Side | 17.137 | 5.831 | 30 |
| 179 | Pressure-Side | 16.451 | 5.559 | 30 |
| 180 | Pressure-Side | 15.770 | 5.280 | 30 |
| 181 | Pressure-Side | 15.092 | 4.991 | 30 |
| 182 | Pressure-Side | 14.417 | 4.696 | 30 |
| 183 | Pressure-Side | 13.746 | 4.394 | 30 |
| 184 | Pressure-Side | 13.076 | 4.087 | 30 |
| 185 | Pressure-Side | 12.409 | 3.775 | 30 |
| 186 | Pressure-Side | 11.742 | 3.460 | 30 |
| 187 | Pressure-Side | 11.077 | 3.143 | 30 |
| 188 | Pressure-Side | 10.412 | 2.827 | 30 |
| 189 | Pressure-Side | 9.746 | 2.514 | 30 |
| 190 | Pressure-Side | 9.077 | 2.205 | 30 |
| 191 | Pressure-Side | 8.404 | 1.905 | 30 |
| 192 | Pressure-Side | 7.726 | 1.617 | 30 |
| 193 | Pressure-Side | 7.039 | 1.348 | 30 |
| 194 | Pressure-Side | 6.344 | 1.107 | 30 |
| 195 | Pressure-Side | 5.636 | 0.902 | 30 |
| 196 | Pressure-Side | 4.916 | 0.748 | 30 |
| 197 | Pressure-Side | 4.185 | 0.663 | 30 |
| 198 | Pressure-Side | 3.449 | 0.669 | 30 |
| 199 | Pressure-Side | 2.722 | 0.780 | 30 |
| 200 | Pressure-Side | 2.019 | 1.003 | 30 |
| 1 | Suction-Side | 2.012 | 3.106 | 40 |
| 2 | Suction-Side | 1.256 | 3.886 | 40 |

TABLE 1-continued

| N | Location | X | Y | Z |
|---|---|---|---|---|
| 3 | Suction-Side | 0.883 | 4.918 | 40 |
| 4 | Suction-Side | 0.743 | 6.009 | 40 |
| 5 | Suction-Side | 0.753 | 7.111 | 40 |
| 6 | Suction-Side | 0.867 | 8.206 | 40 |
| 7 | Suction-Side | 1.062 | 9.290 | 40 |
| 8 | Suction-Side | 1.322 | 10.360 | 40 |
| 9 | Suction-Side | 1.637 | 11.416 | 40 |
| 10 | Suction-Side | 1.998 | 12.457 | 40 |
| 11 | Suction-Side | 2.401 | 13.482 | 40 |
| 12 | Suction-Side | 2.841 | 14.492 | 40 |
| 13 | Suction-Side | 3.318 | 15.486 | 40 |
| 14 | Suction-Side | 3.825 | 16.463 | 40 |
| 15 | Suction-Side | 4.362 | 17.425 | 40 |
| 16 | Suction-Side | 4.928 | 18.369 | 40 |
| 17 | Suction-Side | 5.522 | 19.297 | 40 |
| 18 | Suction-Side | 6.143 | 20.208 | 40 |
| 19 | Suction-Side | 6.789 | 21.099 | 40 |
| 20 | Suction-Side | 7.462 | 21.972 | 40 |
| 21 | Suction-Side | 8.158 | 22.825 | 40 |
| 22 | Suction-Side | 8.879 | 23.658 | 40 |
| 23 | Suction-Side | 9.625 | 24.469 | 40 |
| 24 | Suction-Side | 10.394 | 25.258 | 40 |
| 25 | Suction-Side | 11.187 | 26.022 | 40 |
| 26 | Suction-Side | 12.005 | 26.759 | 40 |
| 27 | Suction-Side | 12.849 | 27.468 | 40 |
| 28 | Suction-Side | 13.715 | 28.148 | 40 |
| 29 | Suction-Side | 14.606 | 28.795 | 40 |
| 30 | Suction-Side | 15.523 | 29.408 | 40 |
| 31 | Suction-Side | 16.463 | 29.981 | 40 |
| 32 | Suction-Side | 17.429 | 30.512 | 40 |
| 33 | Suction-Side | 18.417 | 30.998 | 40 |
| 34 | Suction-Side | 19.429 | 31.433 | 40 |
| 35 | Suction-Side | 20.463 | 31.814 | 40 |
| 36 | Suction-Side | 21.517 | 32.135 | 40 |
| 37 | Suction-Side | 22.587 | 32.393 | 40 |
| 38 | Suction-Side | 23.672 | 32.580 | 40 |
| 39 | Suction-Side | 24.768 | 32.697 | 40 |
| 40 | Suction-Side | 25.869 | 32.734 | 40 |
| 41 | Suction-Side | 26.970 | 32.692 | 40 |
| 42 | Suction-Side | 28.064 | 32.571 | 40 |
| 43 | Suction-Side | 29.147 | 32.369 | 40 |
| 44 | Suction-Side | 30.212 | 32.088 | 40 |
| 45 | Suction-Side | 31.254 | 31.731 | 40 |
| 46 | Suction-Side | 32.268 | 31.303 | 40 |
| 47 | Suction-Side | 33.252 | 30.807 | 40 |
| 48 | Suction-Side | 34.203 | 30.251 | 40 |
| 49 | Suction-Side | 35.118 | 29.639 | 40 |
| 50 | Suction-Side | 35.998 | 28.976 | 40 |
| 51 | Suction-Side | 36.843 | 28.269 | 40 |
| 52 | Suction-Side | 37.653 | 27.522 | 40 |
| 53 | Suction-Side | 38.428 | 26.741 | 40 |
| 54 | Suction-Side | 39.172 | 25.928 | 40 |
| 55 | Suction-Side | 39.885 | 25.088 | 40 |
| 56 | Suction-Side | 40.570 | 24.225 | 40 |
| 57 | Suction-Side | 41.227 | 23.341 | 40 |
| 58 | Suction-Side | 41.858 | 22.438 | 40 |
| 59 | Suction-Side | 42.466 | 21.520 | 40 |
| 60 | Suction-Side | 43.053 | 20.587 | 40 |
| 61 | Suction-Side | 43.620 | 19.643 | 40 |
| 62 | Suction-Side | 44.170 | 18.687 | 40 |
| 63 | Suction-Side | 44.702 | 17.723 | 40 |
| 64 | Suction-Side | 45.218 | 16.750 | 40 |
| 65 | Suction-Side | 45.721 | 15.770 | 40 |
| 66 | Suction-Side | 46.211 | 14.783 | 40 |
| 67 | Suction-Side | 46.689 | 13.790 | 40 |
| 68 | Suction-Side | 47.156 | 12.793 | 40 |
| 69 | Suction-Side | 47.613 | 11.790 | 40 |
| 70 | Suction-Side | 48.061 | 10.784 | 40 |
| 71 | Suction-Side | 48.500 | 9.774 | 40 |
| 72 | Suction-Side | 48.932 | 8.761 | 40 |
| 73 | Suction-Side | 49.357 | 7.744 | 40 |
| 74 | Suction-Side | 49.776 | 6.725 | 40 |
| 75 | Suction-Side | 50.187 | 5.703 | 40 |
| 76 | Suction-Side | 50.593 | 4.679 | 40 |
| 77 | Suction-Side | 50.994 | 3.652 | 40 |
| 78 | Suction-Side | 51.390 | 2.625 | 40 |
| 79 | Suction-Side | 51.780 | 1.595 | 40 |
| 80 | Suction-Side | 52.165 | 0.562 | 40 |

TABLE 1-continued

| N | Location | X | Y | Z |
|---|---|---|---|---|
| 81 | Suction-Side | 52.545 | −0.471 | 40 |
| 82 | Suction-Side | 52.921 | −1.506 | 40 |
| 83 | Suction-Side | 53.292 | −2.545 | 40 |
| 84 | Suction-Side | 53.659 | −3.583 | 40 |
| 85 | Suction-Side | 54.022 | −4.623 | 40 |
| 86 | Suction-Side | 54.381 | −5.665 | 40 |
| 87 | Suction-Side | 54.737 | −6.707 | 40 |
| 88 | Suction-Side | 55.091 | −7.750 | 40 |
| 89 | Suction-Side | 55.443 | −8.794 | 40 |
| 90 | Suction-Side | 55.792 | −9.839 | 40 |
| 91 | Suction-Side | 56.140 | −10.884 | 40 |
| 92 | Suction-Side | 56.485 | −11.930 | 40 |
| 93 | Suction-Side | 56.827 | −12.978 | 40 |
| 94 | Suction-Side | 57.167 | −14.026 | 40 |
| 95 | Suction-Side | 57.503 | −15.075 | 40 |
| 96 | Suction-Side | 57.837 | −16.125 | 40 |
| 97 | Suction-Side | 58.168 | −17.175 | 40 |
| 98 | Suction-Side | 58.496 | −18.227 | 40 |
| 99 | Suction-Side | 58.821 | −19.279 | 40 |
| 100 | Suction-Side | 59.015 | −20.350 | 40 |
| 101 | Pressure-Side | 58.315 | −21.138 | 40 |
| 102 | Pressure-Side | 57.586 | −21.166 | 40 |
| 103 | Pressure-Side | 57.017 | −20.713 | 40 |
| 104 | Pressure-Side | 56.710 | −20.037 | 40 |
| 105 | Pressure-Side | 56.413 | −19.355 | 40 |
| 106 | Pressure-Side | 56.119 | −18.672 | 40 |
| 107 | Pressure-Side | 55.825 | −17.988 | 40 |
| 108 | Pressure-Side | 55.531 | −17.305 | 40 |
| 109 | Pressure-Side | 55.238 | −16.622 | 40 |
| 110 | Pressure-Side | 54.945 | −15.939 | 40 |
| 111 | Pressure-Side | 54.651 | −15.256 | 40 |
| 112 | Pressure-Side | 54.355 | −14.574 | 40 |
| 113 | Pressure-Side | 54.058 | −13.892 | 40 |
| 114 | Pressure-Side | 53.758 | −13.211 | 40 |
| 115 | Pressure-Side | 53.457 | −12.532 | 40 |
| 116 | Pressure-Side | 53.153 | −11.854 | 40 |
| 117 | Pressure-Side | 52.846 | −11.176 | 40 |
| 118 | Pressure-Side | 52.536 | −10.500 | 40 |
| 119 | Pressure-Side | 52.221 | −9.827 | 40 |
| 120 | Pressure-Side | 51.902 | −9.156 | 40 |
| 121 | Pressure-Side | 51.577 | −8.487 | 40 |
| 122 | Pressure-Side | 51.248 | −7.819 | 40 |
| 123 | Pressure-Side | 50.913 | −7.155 | 40 |
| 124 | Pressure-Side | 50.573 | −6.495 | 40 |
| 125 | Pressure-Side | 50.224 | −5.838 | 40 |
| 126 | Pressure-Side | 49.869 | −5.185 | 40 |
| 127 | Pressure-Side | 49.505 | −4.537 | 40 |
| 128 | Pressure-Side | 49.133 | −3.893 | 40 |
| 129 | Pressure-Side | 48.753 | −3.254 | 40 |
| 130 | Pressure-Side | 48.362 | −2.621 | 40 |
| 131 | Pressure-Side | 47.962 | −1.994 | 40 |
| 132 | Pressure-Side | 47.551 | −1.375 | 40 |
| 133 | Pressure-Side | 47.129 | −0.763 | 40 |
| 134 | Pressure-Side | 46.696 | −0.158 | 40 |
| 135 | Pressure-Side | 46.251 | 0.438 | 40 |
| 136 | Pressure-Side | 45.795 | 1.025 | 40 |
| 137 | Pressure-Side | 45.326 | 1.602 | 40 |
| 138 | Pressure-Side | 44.844 | 2.168 | 40 |
| 139 | Pressure-Side | 44.349 | 2.723 | 40 |
| 140 | Pressure-Side | 43.841 | 3.265 | 40 |
| 141 | Pressure-Side | 43.318 | 3.794 | 40 |
| 142 | Pressure-Side | 42.782 | 4.309 | 40 |
| 143 | Pressure-Side | 42.230 | 4.808 | 40 |
| 144 | Pressure-Side | 41.666 | 5.292 | 40 |
| 145 | Pressure-Side | 41.085 | 5.757 | 40 |
| 146 | Pressure-Side | 40.492 | 6.204 | 40 |
| 147 | Pressure-Side | 39.883 | 6.631 | 40 |
| 148 | Pressure-Side | 39.261 | 7.038 | 40 |
| 149 | Pressure-Side | 38.626 | 7.423 | 40 |
| 150 | Pressure-Side | 37.976 | 7.787 | 40 |
| 151 | Pressure-Side | 37.314 | 8.126 | 40 |
| 152 | Pressure-Side | 36.641 | 8.440 | 40 |
| 153 | Pressure-Side | 35.957 | 8.730 | 40 |
| 154 | Pressure-Side | 35.262 | 8.994 | 40 |
| 155 | Pressure-Side | 34.557 | 9.231 | 40 |
| 156 | Pressure-Side | 33.844 | 9.440 | 40 |
| 157 | Pressure-Side | 33.122 | 9.624 | 40 |
| 158 | Pressure-Side | 32.395 | 9.778 | 40 |

TABLE 1-continued

| N | Location | X | Y | Z |
|---|---|---|---|---|
| 159 | Pressure-Side | 31.663 | 9.905 | 40 |
| 160 | Pressure-Side | 30.926 | 10.004 | 40 |
| 161 | Pressure-Side | 30.185 | 10.075 | 40 |
| 162 | Pressure-Side | 29.444 | 10.119 | 40 |
| 163 | Pressure-Side | 28.701 | 10.136 | 40 |
| 164 | Pressure-Side | 27.957 | 10.126 | 40 |
| 165 | Pressure-Side | 27.214 | 10.091 | 40 |
| 166 | Pressure-Side | 26.473 | 10.033 | 40 |
| 167 | Pressure-Side | 25.734 | 9.950 | 40 |
| 168 | Pressure-Side | 24.998 | 9.844 | 40 |
| 169 | Pressure-Side | 24.266 | 9.717 | 40 |
| 170 | Pressure-Side | 23.537 | 9.570 | 40 |
| 171 | Pressure-Side | 22.812 | 9.402 | 40 |
| 172 | Pressure-Side | 22.092 | 9.217 | 40 |
| 173 | Pressure-Side | 21.378 | 9.013 | 40 |
| 174 | Pressure-Side | 20.667 | 8.793 | 40 |
| 175 | Pressure-Side | 19.961 | 8.559 | 40 |
| 176 | Pressure-Side | 19.261 | 8.310 | 40 |
| 177 | Pressure-Side | 18.565 | 8.047 | 40 |
| 178 | Pressure-Side | 17.875 | 7.773 | 40 |
| 179 | Pressure-Side | 17.188 | 7.487 | 40 |
| 180 | Pressure-Side | 16.506 | 7.190 | 40 |
| 181 | Pressure-Side | 15.828 | 6.886 | 40 |
| 182 | Pressure-Side | 15.153 | 6.573 | 40 |
| 183 | Pressure-Side | 14.482 | 6.253 | 40 |
| 184 | Pressure-Side | 13.813 | 5.928 | 40 |
| 185 | Pressure-Side | 13.147 | 5.598 | 40 |
| 186 | Pressure-Side | 12.482 | 5.266 | 40 |
| 187 | Pressure-Side | 11.816 | 4.934 | 40 |
| 188 | Pressure-Side | 11.151 | 4.601 | 40 |
| 189 | Pressure-Side | 10.484 | 4.273 | 40 |
| 190 | Pressure-Side | 9.813 | 3.954 | 40 |
| 191 | Pressure-Side | 9.137 | 3.644 | 40 |
| 192 | Pressure-Side | 8.453 | 3.350 | 40 |
| 193 | Pressure-Side | 7.762 | 3.078 | 40 |
| 194 | Pressure-Side | 7.057 | 2.839 | 40 |
| 195 | Pressure-Side | 6.342 | 2.640 | 40 |
| 196 | Pressure-Side | 5.612 | 2.498 | 40 |
| 197 | Pressure-Side | 4.872 | 2.430 | 40 |
| 198 | Pressure-Side | 4.129 | 2.450 | 40 |
| 199 | Pressure-Side | 3.396 | 2.573 | 40 |
| 200 | Pressure-Side | 2.688 | 2.797 | 40 |
| 1 | Suction-Side | 2.704 | 5.179 | 50 |
| 2 | Suction-Side | 1.967 | 5.952 | 50 |
| 3 | Suction-Side | 1.631 | 6.980 | 50 |
| 4 | Suction-Side | 1.527 | 8.060 | 50 |
| 5 | Suction-Side | 1.570 | 9.144 | 50 |
| 6 | Suction-Side | 1.713 | 10.219 | 50 |
| 7 | Suction-Side | 1.937 | 11.282 | 50 |
| 8 | Suction-Side | 2.223 | 12.328 | 50 |
| 9 | Suction-Side | 2.564 | 13.360 | 50 |
| 10 | Suction-Side | 2.950 | 14.374 | 50 |
| 11 | Suction-Side | 3.377 | 15.373 | 50 |
| 12 | Suction-Side | 3.842 | 16.354 | 50 |
| 13 | Suction-Side | 4.340 | 17.319 | 50 |
| 14 | Suction-Side | 4.870 | 18.265 | 50 |
| 15 | Suction-Side | 5.431 | 19.196 | 50 |
| 16 | Suction-Side | 6.021 | 20.107 | 50 |
| 17 | Suction-Side | 6.639 | 21.000 | 50 |
| 18 | Suction-Side | 7.281 | 21.874 | 50 |
| 19 | Suction-Side | 7.951 | 22.730 | 50 |
| 20 | Suction-Side | 8.645 | 23.565 | 50 |
| 21 | Suction-Side | 9.364 | 24.377 | 50 |
| 22 | Suction-Side | 10.108 | 25.168 | 50 |
| 23 | Suction-Side | 10.876 | 25.936 | 50 |
| 24 | Suction-Side | 11.669 | 26.678 | 50 |
| 25 | Suction-Side | 12.485 | 27.393 | 50 |
| 26 | Suction-Side | 13.325 | 28.081 | 50 |
| 27 | Suction-Side | 14.190 | 28.738 | 50 |
| 28 | Suction-Side | 15.079 | 29.361 | 50 |
| 29 | Suction-Side | 15.991 | 29.950 | 50 |
| 30 | Suction-Side | 16.926 | 30.500 | 50 |
| 31 | Suction-Side | 17.886 | 31.008 | 50 |
| 32 | Suction-Side | 18.868 | 31.471 | 50 |
| 33 | Suction-Side | 19.873 | 31.884 | 50 |
| 34 | Suction-Side | 20.897 | 32.242 | 50 |
| 35 | Suction-Side | 21.940 | 32.542 | 50 |
| 36 | Suction-Side | 23.000 | 32.778 | 50 |

TABLE 1-continued

| N | Location | X | Y | Z |
|---|---|---|---|---|
| 37 | Suction-Side | 24.073 | 32.944 | 50 |
| 38 | Suction-Side | 25.155 | 33.037 | 50 |
| 39 | Suction-Side | 26.240 | 33.054 | 50 |
| 40 | Suction-Side | 27.324 | 32.990 | 50 |
| 41 | Suction-Side | 28.399 | 32.845 | 50 |
| 42 | Suction-Side | 29.460 | 32.620 | 50 |
| 43 | Suction-Side | 30.502 | 32.315 | 50 |
| 44 | Suction-Side | 31.519 | 31.933 | 50 |
| 45 | Suction-Side | 32.505 | 31.481 | 50 |
| 46 | Suction-Side | 33.460 | 30.963 | 50 |
| 47 | Suction-Side | 34.380 | 30.386 | 50 |
| 48 | Suction-Side | 35.263 | 29.756 | 50 |
| 49 | Suction-Side | 36.110 | 29.076 | 50 |
| 50 | Suction-Side | 36.922 | 28.356 | 50 |
| 51 | Suction-Side | 37.700 | 27.599 | 50 |
| 52 | Suction-Side | 38.444 | 26.808 | 50 |
| 53 | Suction-Side | 39.157 | 25.990 | 50 |
| 54 | Suction-Side | 39.841 | 25.146 | 50 |
| 55 | Suction-Side | 40.497 | 24.281 | 50 |
| 56 | Suction-Side | 41.128 | 23.398 | 50 |
| 57 | Suction-Side | 41.735 | 22.498 | 50 |
| 58 | Suction-Side | 42.320 | 21.584 | 50 |
| 59 | Suction-Side | 42.885 | 20.656 | 50 |
| 60 | Suction-Side | 43.430 | 19.717 | 50 |
| 61 | Suction-Side | 43.959 | 18.768 | 50 |
| 62 | Suction-Side | 44.472 | 17.811 | 50 |
| 63 | Suction-Side | 44.970 | 16.847 | 50 |
| 64 | Suction-Side | 45.455 | 15.876 | 50 |
| 65 | Suction-Side | 45.927 | 14.898 | 50 |
| 66 | Suction-Side | 46.389 | 13.915 | 50 |
| 67 | Suction-Side | 46.840 | 12.928 | 50 |
| 68 | Suction-Side | 47.281 | 11.936 | 50 |
| 69 | Suction-Side | 47.713 | 10.940 | 50 |
| 70 | Suction-Side | 48.138 | 9.941 | 50 |
| 71 | Suction-Side | 48.555 | 8.938 | 50 |
| 72 | Suction-Side | 48.966 | 7.933 | 50 |
| 73 | Suction-Side | 49.370 | 6.926 | 50 |
| 74 | Suction-Side | 49.767 | 5.915 | 50 |
| 75 | Suction-Side | 50.161 | 4.903 | 50 |
| 76 | Suction-Side | 50.549 | 3.888 | 50 |
| 77 | Suction-Side | 50.931 | 2.872 | 50 |
| 78 | Suction-Side | 51.309 | 1.856 | 50 |
| 79 | Suction-Side | 51.683 | 0.836 | 50 |
| 80 | Suction-Side | 52.052 | −0.185 | 50 |
| 81 | Suction-Side | 52.417 | −1.208 | 50 |
| 82 | Suction-Side | 52.777 | −2.232 | 50 |
| 83 | Suction-Side | 53.134 | −3.258 | 50 |
| 84 | Suction-Side | 53.487 | −4.284 | 50 |
| 85 | Suction-Side | 53.835 | −5.313 | 50 |
| 86 | Suction-Side | 54.182 | −6.342 | 50 |
| 87 | Suction-Side | 54.525 | −7.372 | 50 |
| 88 | Suction-Side | 54.867 | −8.402 | 50 |
| 89 | Suction-Side | 55.207 | −9.433 | 50 |
| 90 | Suction-Side | 55.546 | −10.465 | 50 |
| 91 | Suction-Side | 55.882 | −11.497 | 50 |
| 92 | Suction-Side | 56.216 | −12.531 | 50 |
| 93 | Suction-Side | 56.547 | −13.564 | 50 |
| 94 | Suction-Side | 56.876 | −14.599 | 50 |
| 95 | Suction-Side | 57.202 | −15.635 | 50 |
| 96 | Suction-Side | 57.526 | −16.671 | 50 |
| 97 | Suction-Side | 57.846 | −17.709 | 50 |
| 98 | Suction-Side | 58.165 | −18.747 | 50 |
| 99 | Suction-Side | 58.480 | −19.785 | 50 |
| 100 | Suction-Side | 58.671 | −20.842 | 50 |
| 101 | Pressure-Side | 57.980 | −21.618 | 50 |
| 102 | Pressure-Side | 57.248 | −21.637 | 50 |
| 103 | Pressure-Side | 56.690 | −21.166 | 50 |
| 104 | Pressure-Side | 56.384 | −20.484 | 50 |
| 105 | Pressure-Side | 56.087 | −19.797 | 50 |
| 106 | Pressure-Side | 55.790 | −19.112 | 50 |
| 107 | Pressure-Side | 55.496 | −18.424 | 50 |
| 108 | Pressure-Side | 55.201 | −17.737 | 50 |
| 109 | Pressure-Side | 54.908 | −17.049 | 50 |
| 110 | Pressure-Side | 54.615 | −16.361 | 50 |
| 111 | Pressure-Side | 54.322 | −15.674 | 50 |
| 112 | Pressure-Side | 54.029 | −14.986 | 50 |
| 113 | Pressure-Side | 53.735 | −14.299 | 50 |
| 114 | Pressure-Side | 53.439 | −13.612 | 50 |

TABLE 1-continued

| N | Location | X | Y | Z |
|---|---|---|---|---|
| 115 | Pressure-Side | 53.141 | −12.925 | 50 |
| 116 | Pressure-Side | 52.842 | −12.240 | 50 |
| 117 | Pressure-Side | 52.541 | −11.556 | 50 |
| 118 | Pressure-Side | 52.238 | −10.873 | 50 |
| 119 | Pressure-Side | 51.930 | −10.191 | 50 |
| 120 | Pressure-Side | 51.621 | −9.511 | 50 |
| 121 | Pressure-Side | 51.308 | −8.832 | 50 |
| 122 | Pressure-Side | 50.990 | −8.154 | 50 |
| 123 | Pressure-Side | 50.668 | −7.480 | 50 |
| 124 | Pressure-Side | 50.342 | −6.807 | 50 |
| 125 | Pressure-Side | 50.010 | −6.137 | 50 |
| 126 | Pressure-Side | 49.672 | −5.471 | 50 |
| 127 | Pressure-Side | 49.327 | −4.807 | 50 |
| 128 | Pressure-Side | 48.975 | −4.147 | 50 |
| 129 | Pressure-Side | 48.618 | −3.491 | 50 |
| 130 | Pressure-Side | 48.250 | −2.839 | 50 |
| 131 | Pressure-Side | 47.876 | −2.192 | 50 |
| 132 | Pressure-Side | 47.493 | −1.550 | 50 |
| 133 | Pressure-Side | 47.102 | −0.914 | 50 |
| 134 | Pressure-Side | 46.700 | −0.282 | 50 |
| 135 | Pressure-Side | 46.290 | 0.342 | 50 |
| 136 | Pressure-Side | 45.867 | 0.959 | 50 |
| 137 | Pressure-Side | 45.435 | 1.570 | 50 |
| 138 | Pressure-Side | 44.993 | 2.173 | 50 |
| 139 | Pressure-Side | 44.538 | 2.766 | 50 |
| 140 | Pressure-Side | 44.072 | 3.350 | 50 |
| 141 | Pressure-Side | 43.593 | 3.924 | 50 |
| 142 | Pressure-Side | 43.100 | 4.486 | 50 |
| 143 | Pressure-Side | 42.594 | 5.037 | 50 |
| 144 | Pressure-Side | 42.075 | 5.574 | 50 |
| 145 | Pressure-Side | 41.541 | 6.098 | 50 |
| 146 | Pressure-Side | 40.992 | 6.606 | 50 |
| 147 | Pressure-Side | 40.429 | 7.097 | 50 |
| 148 | Pressure-Side | 39.851 | 7.572 | 50 |
| 149 | Pressure-Side | 39.257 | 8.026 | 50 |
| 150 | Pressure-Side | 38.650 | 8.461 | 50 |
| 151 | Pressure-Side | 38.026 | 8.873 | 50 |
| 152 | Pressure-Side | 37.389 | 9.263 | 50 |
| 153 | Pressure-Side | 36.737 | 9.630 | 50 |
| 154 | Pressure-Side | 36.070 | 9.969 | 50 |
| 155 | Pressure-Side | 35.392 | 10.284 | 50 |
| 156 | Pressure-Side | 34.702 | 10.570 | 50 |
| 157 | Pressure-Side | 33.999 | 10.827 | 50 |
| 158 | Pressure-Side | 33.288 | 11.054 | 50 |
| 159 | Pressure-Side | 32.566 | 11.252 | 50 |
| 160 | Pressure-Side | 31.838 | 11.419 | 50 |
| 161 | Pressure-Side | 31.103 | 11.556 | 50 |
| 162 | Pressure-Side | 30.362 | 11.662 | 50 |
| 163 | Pressure-Side | 29.618 | 11.736 | 50 |
| 164 | Pressure-Side | 28.872 | 11.782 | 50 |
| 165 | Pressure-Side | 28.125 | 11.797 | 50 |
| 166 | Pressure-Side | 27.378 | 11.784 | 50 |
| 167 | Pressure-Side | 26.631 | 11.742 | 50 |
| 168 | Pressure-Side | 25.886 | 11.675 | 50 |
| 169 | Pressure-Side | 25.144 | 11.582 | 50 |
| 170 | Pressure-Side | 24.406 | 11.464 | 50 |
| 171 | Pressure-Side | 23.672 | 11.322 | 50 |
| 172 | Pressure-Side | 22.943 | 11.160 | 50 |
| 173 | Pressure-Side | 22.218 | 10.975 | 50 |
| 174 | Pressure-Side | 21.499 | 10.772 | 50 |
| 175 | Pressure-Side | 20.784 | 10.551 | 50 |
| 176 | Pressure-Side | 20.076 | 10.313 | 50 |
| 177 | Pressure-Side | 19.373 | 10.058 | 50 |
| 178 | Pressure-Side | 18.675 | 9.790 | 50 |
| 179 | Pressure-Side | 17.982 | 9.507 | 50 |
| 180 | Pressure-Side | 17.295 | 9.214 | 50 |
| 181 | Pressure-Side | 16.611 | 8.910 | 50 |
| 182 | Pressure-Side | 15.932 | 8.597 | 50 |
| 183 | Pressure-Side | 15.257 | 8.276 | 50 |
| 184 | Pressure-Side | 14.585 | 7.950 | 50 |
| 185 | Pressure-Side | 13.915 | 7.618 | 50 |
| 186 | Pressure-Side | 13.246 | 7.283 | 50 |
| 187 | Pressure-Side | 12.577 | 6.948 | 50 |
| 188 | Pressure-Side | 11.909 | 6.615 | 50 |
| 189 | Pressure-Side | 11.237 | 6.286 | 50 |
| 190 | Pressure-Side | 10.561 | 5.965 | 50 |
| 191 | Pressure-Side | 9.881 | 5.656 | 50 |
| 192 | Pressure-Side | 9.193 | 5.366 | 50 |

TABLE 1-continued

| N | Location | X | Y | Z |
|---|---|---|---|---|
| 193 | Pressure-Side | 8.494 | 5.098 | 50 |
| 194 | Pressure-Side | 7.784 | 4.864 | 50 |
| 195 | Pressure-Side | 7.061 | 4.675 | 50 |
| 196 | Pressure-Side | 6.325 | 4.544 | 50 |
| 197 | Pressure-Side | 5.580 | 4.488 | 50 |
| 198 | Pressure-Side | 4.833 | 4.519 | 50 |
| 199 | Pressure-Side | 4.098 | 4.648 | 50 |
| 200 | Pressure-Side | 3.385 | 4.872 | 50 |
| 1 | Suction-Side | 3.405 | 7.149 | 60 |
| 2 | Suction-Side | 2.694 | 7.928 | 60 |
| 3 | Suction-Side | 2.375 | 8.946 | 60 |
| 4 | Suction-Side | 2.279 | 10.012 | 60 |
| 5 | Suction-Side | 2.325 | 11.082 | 60 |
| 6 | Suction-Side | 2.469 | 12.143 | 60 |
| 7 | Suction-Side | 2.692 | 13.191 | 60 |
| 8 | Suction-Side | 2.977 | 14.224 | 60 |
| 9 | Suction-Side | 3.314 | 15.240 | 60 |
| 10 | Suction-Side | 3.698 | 16.241 | 60 |
| 11 | Suction-Side | 4.124 | 17.223 | 60 |
| 12 | Suction-Side | 4.588 | 18.188 | 60 |
| 13 | Suction-Side | 5.088 | 19.136 | 60 |
| 14 | Suction-Side | 5.620 | 20.065 | 60 |
| 15 | Suction-Side | 6.184 | 20.977 | 60 |
| 16 | Suction-Side | 6.779 | 21.867 | 60 |
| 17 | Suction-Side | 7.402 | 22.738 | 60 |
| 18 | Suction-Side | 8.054 | 23.589 | 60 |
| 19 | Suction-Side | 8.735 | 24.415 | 60 |
| 20 | Suction-Side | 9.442 | 25.220 | 60 |
| 21 | Suction-Side | 10.177 | 25.999 | 60 |
| 22 | Suction-Side | 10.938 | 26.753 | 60 |
| 23 | Suction-Side | 11.727 | 27.478 | 60 |
| 24 | Suction-Side | 12.541 | 28.174 | 60 |
| 25 | Suction-Side | 13.382 | 28.838 | 60 |
| 26 | Suction-Side | 14.249 | 29.468 | 60 |
| 27 | Suction-Side | 15.141 | 30.060 | 60 |
| 28 | Suction-Side | 16.058 | 30.614 | 60 |
| 29 | Suction-Side | 16.999 | 31.125 | 60 |
| 30 | Suction-Side | 17.965 | 31.590 | 60 |
| 31 | Suction-Side | 18.952 | 32.006 | 60 |
| 32 | Suction-Side | 19.959 | 32.370 | 60 |
| 33 | Suction-Side | 20.984 | 32.677 | 60 |
| 34 | Suction-Side | 22.027 | 32.924 | 60 |
| 35 | Suction-Side | 23.083 | 33.108 | 60 |
| 36 | Suction-Side | 24.147 | 33.223 | 60 |
| 37 | Suction-Side | 25.217 | 33.267 | 60 |
| 38 | Suction-Side | 26.288 | 33.238 | 60 |
| 39 | Suction-Side | 27.354 | 33.134 | 60 |
| 40 | Suction-Side | 28.409 | 32.953 | 60 |
| 41 | Suction-Side | 29.448 | 32.695 | 60 |
| 42 | Suction-Side | 30.468 | 32.364 | 60 |
| 43 | Suction-Side | 31.459 | 31.962 | 60 |
| 44 | Suction-Side | 32.423 | 31.492 | 60 |
| 45 | Suction-Side | 33.352 | 30.959 | 60 |
| 46 | Suction-Side | 34.247 | 30.372 | 60 |
| 47 | Suction-Side | 35.107 | 29.733 | 60 |
| 48 | Suction-Side | 35.931 | 29.050 | 60 |
| 49 | Suction-Side | 36.721 | 28.326 | 60 |
| 50 | Suction-Side | 37.477 | 27.567 | 60 |
| 51 | Suction-Side | 38.202 | 26.778 | 60 |
| 52 | Suction-Side | 38.896 | 25.962 | 60 |
| 53 | Suction-Side | 39.561 | 25.122 | 60 |
| 54 | Suction-Side | 40.200 | 24.262 | 60 |
| 55 | Suction-Side | 40.815 | 23.385 | 60 |
| 56 | Suction-Side | 41.406 | 22.492 | 60 |
| 57 | Suction-Side | 41.977 | 21.585 | 60 |
| 58 | Suction-Side | 42.527 | 20.666 | 60 |
| 59 | Suction-Side | 43.059 | 19.736 | 60 |
| 60 | Suction-Side | 43.575 | 18.797 | 60 |
| 61 | Suction-Side | 44.075 | 17.850 | 60 |
| 62 | Suction-Side | 44.562 | 16.896 | 60 |
| 63 | Suction-Side | 45.035 | 15.934 | 60 |
| 64 | Suction-Side | 45.496 | 14.968 | 60 |
| 65 | Suction-Side | 45.947 | 13.996 | 60 |
| 66 | Suction-Side | 46.388 | 13.020 | 60 |
| 67 | Suction-Side | 46.818 | 12.039 | 60 |
| 68 | Suction-Side | 47.242 | 11.054 | 60 |
| 69 | Suction-Side | 47.656 | 10.067 | 60 |
| 70 | Suction-Side | 48.064 | 9.077 | 60 |

TABLE 1-continued

| N | Location | X | Y | Z |
|---|---|---|---|---|
| 71 | Suction-Side | 48.465 | 8.083 | 60 |
| 72 | Suction-Side | 48.861 | 7.087 | 60 |
| 73 | Suction-Side | 49.249 | 6.089 | 60 |
| 74 | Suction-Side | 49.633 | 5.089 | 60 |
| 75 | Suction-Side | 50.013 | 4.087 | 60 |
| 76 | Suction-Side | 50.387 | 3.083 | 60 |
| 77 | Suction-Side | 50.757 | 2.078 | 60 |
| 78 | Suction-Side | 51.124 | 1.072 | 60 |
| 79 | Suction-Side | 51.487 | 0.063 | 60 |
| 80 | Suction-Side | 51.844 | −0.946 | 60 |
| 81 | Suction-Side | 52.200 | −1.957 | 60 |
| 82 | Suction-Side | 52.550 | −2.969 | 60 |
| 83 | Suction-Side | 52.897 | −3.983 | 60 |
| 84 | Suction-Side | 53.240 | −4.997 | 60 |
| 85 | Suction-Side | 53.581 | −6.013 | 60 |
| 86 | Suction-Side | 53.920 | −7.030 | 60 |
| 87 | Suction-Side | 54.256 | −8.047 | 60 |
| 88 | Suction-Side | 54.591 | −9.064 | 60 |
| 89 | Suction-Side | 54.925 | −10.082 | 60 |
| 90 | Suction-Side | 55.256 | −11.100 | 60 |
| 91 | Suction-Side | 55.588 | −12.119 | 60 |
| 92 | Suction-Side | 55.915 | −13.138 | 60 |
| 93 | Suction-Side | 56.242 | −14.159 | 60 |
| 94 | Suction-Side | 56.566 | −15.181 | 60 |
| 95 | Suction-Side | 56.888 | −16.202 | 60 |
| 96 | Suction-Side | 57.208 | −17.225 | 60 |
| 97 | Suction-Side | 57.525 | −18.248 | 60 |
| 98 | Suction-Side | 57.839 | −19.272 | 60 |
| 99 | Suction-Side | 58.151 | −20.297 | 60 |
| 100 | Suction-Side | 58.344 | −21.338 | 60 |
| 101 | Pressure-Side | 57.669 | −22.109 | 60 |
| 102 | Pressure-Side | 56.938 | −22.124 | 60 |
| 103 | Pressure-Side | 56.390 | −21.643 | 60 |
| 104 | Pressure-Side | 56.084 | −20.963 | 60 |
| 105 | Pressure-Side | 55.784 | −20.279 | 60 |
| 106 | Pressure-Side | 55.485 | −19.596 | 60 |
| 107 | Pressure-Side | 55.186 | −18.912 | 60 |
| 108 | Pressure-Side | 54.889 | −18.228 | 60 |
| 109 | Pressure-Side | 54.591 | −17.543 | 60 |
| 110 | Pressure-Side | 54.294 | −16.859 | 60 |
| 111 | Pressure-Side | 53.998 | −16.175 | 60 |
| 112 | Pressure-Side | 53.701 | −15.489 | 60 |
| 113 | Pressure-Side | 53.403 | −14.805 | 60 |
| 114 | Pressure-Side | 53.105 | −14.122 | 60 |
| 115 | Pressure-Side | 52.806 | −13.438 | 60 |
| 116 | Pressure-Side | 52.506 | −12.754 | 60 |
| 117 | Pressure-Side | 52.204 | −12.072 | 60 |
| 118 | Pressure-Side | 51.902 | −11.391 | 60 |
| 119 | Pressure-Side | 51.597 | −10.710 | 60 |
| 120 | Pressure-Side | 51.288 | −10.029 | 60 |
| 121 | Pressure-Side | 50.978 | −9.351 | 60 |
| 122 | Pressure-Side | 50.665 | −8.674 | 60 |
| 123 | Pressure-Side | 50.349 | −7.998 | 60 |
| 124 | Pressure-Side | 50.028 | −7.324 | 60 |
| 125 | Pressure-Side | 49.704 | −6.652 | 60 |
| 126 | Pressure-Side | 49.375 | −5.982 | 60 |
| 127 | Pressure-Side | 49.041 | −5.315 | 60 |
| 128 | Pressure-Side | 48.701 | −4.650 | 60 |
| 129 | Pressure-Side | 48.357 | −3.989 | 60 |
| 130 | Pressure-Side | 48.005 | −3.331 | 60 |
| 131 | Pressure-Side | 47.647 | −2.676 | 60 |
| 132 | Pressure-Side | 47.284 | −2.024 | 60 |
| 133 | Pressure-Side | 46.912 | −1.378 | 60 |
| 134 | Pressure-Side | 46.532 | −0.735 | 60 |
| 135 | Pressure-Side | 46.145 | −0.097 | 60 |
| 136 | Pressure-Side | 45.750 | 0.536 | 60 |
| 137 | Pressure-Side | 45.346 | 1.163 | 60 |
| 138 | Pressure-Side | 44.932 | 1.784 | 60 |
| 139 | Pressure-Side | 44.508 | 2.399 | 60 |
| 140 | Pressure-Side | 44.075 | 3.005 | 60 |
| 141 | Pressure-Side | 43.631 | 3.606 | 60 |
| 142 | Pressure-Side | 43.175 | 4.197 | 60 |
| 143 | Pressure-Side | 42.709 | 4.778 | 60 |
| 144 | Pressure-Side | 42.228 | 5.349 | 60 |
| 145 | Pressure-Side | 41.735 | 5.910 | 60 |
| 146 | Pressure-Side | 41.229 | 6.458 | 60 |
| 147 | Pressure-Side | 40.709 | 6.993 | 60 |
| 148 | Pressure-Side | 40.174 | 7.512 | 60 |

TABLE 1-continued

| N | Location | X | Y | Z |
|---|---|---|---|---|
| 149 | Pressure-Side | 39.623 | 8.017 | 60 |
| 150 | Pressure-Side | 39.059 | 8.504 | 60 |
| 151 | Pressure-Side | 38.479 | 8.974 | 60 |
| 152 | Pressure-Side | 37.884 | 9.424 | 60 |
| 153 | Pressure-Side | 37.273 | 9.852 | 60 |
| 154 | Pressure-Side | 36.647 | 10.259 | 60 |
| 155 | Pressure-Side | 36.007 | 10.642 | 60 |
| 156 | Pressure-Side | 35.352 | 10.998 | 60 |
| 157 | Pressure-Side | 34.684 | 11.330 | 60 |
| 158 | Pressure-Side | 34.002 | 11.633 | 60 |
| 159 | Pressure-Side | 33.308 | 11.909 | 60 |
| 160 | Pressure-Side | 32.603 | 12.155 | 60 |
| 161 | Pressure-Side | 31.890 | 12.370 | 60 |
| 162 | Pressure-Side | 31.166 | 12.556 | 60 |
| 163 | Pressure-Side | 30.437 | 12.710 | 60 |
| 164 | Pressure-Side | 29.701 | 12.833 | 60 |
| 165 | Pressure-Side | 28.960 | 12.927 | 60 |
| 166 | Pressure-Side | 28.217 | 12.989 | 60 |
| 167 | Pressure-Side | 27.472 | 13.021 | 60 |
| 168 | Pressure-Side | 26.725 | 13.024 | 60 |
| 169 | Pressure-Side | 25.980 | 12.998 | 60 |
| 170 | Pressure-Side | 25.236 | 12.946 | 60 |
| 171 | Pressure-Side | 24.494 | 12.866 | 60 |
| 172 | Pressure-Side | 23.755 | 12.760 | 60 |
| 173 | Pressure-Side | 23.020 | 12.630 | 60 |
| 174 | Pressure-Side | 22.291 | 12.477 | 60 |
| 175 | Pressure-Side | 21.566 | 12.301 | 60 |
| 176 | Pressure-Side | 20.845 | 12.106 | 60 |
| 177 | Pressure-Side | 20.131 | 11.891 | 60 |
| 178 | Pressure-Side | 19.422 | 11.659 | 60 |
| 179 | Pressure-Side | 18.718 | 11.408 | 60 |
| 180 | Pressure-Side | 18.021 | 11.144 | 60 |
| 181 | Pressure-Side | 17.328 | 10.867 | 60 |
| 182 | Pressure-Side | 16.640 | 10.577 | 60 |
| 183 | Pressure-Side | 15.957 | 10.277 | 60 |
| 184 | Pressure-Side | 15.279 | 9.967 | 60 |
| 185 | Pressure-Side | 14.603 | 9.651 | 60 |
| 186 | Pressure-Side | 13.929 | 9.330 | 60 |
| 187 | Pressure-Side | 13.257 | 9.006 | 60 |
| 188 | Pressure-Side | 12.585 | 8.682 | 60 |
| 189 | Pressure-Side | 11.911 | 8.360 | 60 |
| 190 | Pressure-Side | 11.236 | 8.044 | 60 |
| 191 | Pressure-Side | 10.555 | 7.737 | 60 |
| 192 | Pressure-Side | 9.869 | 7.445 | 60 |
| 193 | Pressure-Side | 9.174 | 7.175 | 60 |
| 194 | Pressure-Side | 8.468 | 6.933 | 60 |
| 195 | Pressure-Side | 7.749 | 6.731 | 60 |
| 196 | Pressure-Side | 7.018 | 6.582 | 60 |
| 197 | Pressure-Side | 6.277 | 6.503 | 60 |
| 198 | Pressure-Side | 5.531 | 6.511 | 60 |
| 199 | Pressure-Side | 4.794 | 6.618 | 60 |
| 200 | Pressure-Side | 4.080 | 6.834 | 60 |
| 1 | Suction-Side | 4.070 | 9.363 | 70 |
| 2 | Suction-Side | 3.396 | 10.154 | 70 |
| 3 | Suction-Side | 3.089 | 11.158 | 70 |
| 4 | Suction-Side | 2.996 | 12.208 | 70 |
| 5 | Suction-Side | 3.040 | 13.260 | 70 |
| 6 | Suction-Side | 3.182 | 14.305 | 70 |
| 7 | Suction-Side | 3.400 | 15.335 | 70 |
| 8 | Suction-Side | 3.681 | 16.352 | 70 |
| 9 | Suction-Side | 4.015 | 17.351 | 70 |
| 10 | Suction-Side | 4.397 | 18.334 | 70 |
| 11 | Suction-Side | 4.821 | 19.298 | 70 |
| 12 | Suction-Side | 5.284 | 20.246 | 70 |
| 13 | Suction-Side | 5.784 | 21.173 | 70 |
| 14 | Suction-Side | 6.320 | 22.081 | 70 |
| 15 | Suction-Side | 6.890 | 22.969 | 70 |
| 16 | Suction-Side | 7.492 | 23.834 | 70 |
| 17 | Suction-Side | 8.126 | 24.676 | 70 |
| 18 | Suction-Side | 8.791 | 25.494 | 70 |
| 19 | Suction-Side | 9.486 | 26.286 | 70 |
| 20 | Suction-Side | 10.212 | 27.051 | 70 |
| 21 | Suction-Side | 10.968 | 27.785 | 70 |
| 22 | Suction-Side | 11.753 | 28.488 | 70 |
| 23 | Suction-Side | 12.568 | 29.158 | 70 |
| 24 | Suction-Side | 13.411 | 29.789 | 70 |
| 25 | Suction-Side | 14.282 | 30.383 | 70 |
| 26 | Suction-Side | 15.182 | 30.933 | 70 |

TABLE 1-continued

| N | Location | X | Y | Z |
|---|---|---|---|---|
| 27 | Suction-Side | 16.107 | 31.438 | 70 |
| 28 | Suction-Side | 17.057 | 31.894 | 70 |
| 29 | Suction-Side | 18.030 | 32.299 | 70 |
| 30 | Suction-Side | 19.025 | 32.647 | 70 |
| 31 | Suction-Side | 20.038 | 32.939 | 70 |
| 32 | Suction-Side | 21.067 | 33.169 | 70 |
| 33 | Suction-Side | 22.108 | 33.335 | 70 |
| 34 | Suction-Side | 23.157 | 33.436 | 70 |
| 35 | Suction-Side | 24.210 | 33.468 | 70 |
| 36 | Suction-Side | 25.264 | 33.431 | 70 |
| 37 | Suction-Side | 26.312 | 33.325 | 70 |
| 38 | Suction-Side | 27.351 | 33.149 | 70 |
| 39 | Suction-Side | 28.376 | 32.902 | 70 |
| 40 | Suction-Side | 29.383 | 32.588 | 70 |
| 41 | Suction-Side | 30.365 | 32.208 | 70 |
| 42 | Suction-Side | 31.323 | 31.767 | 70 |
| 43 | Suction-Side | 32.250 | 31.268 | 70 |
| 44 | Suction-Side | 33.148 | 30.713 | 70 |
| 45 | Suction-Side | 34.011 | 30.109 | 70 |
| 46 | Suction-Side | 34.842 | 29.460 | 70 |
| 47 | Suction-Side | 35.640 | 28.771 | 70 |
| 48 | Suction-Side | 36.405 | 28.046 | 70 |
| 49 | Suction-Side | 37.139 | 27.290 | 70 |
| 50 | Suction-Side | 37.843 | 26.505 | 70 |
| 51 | Suction-Side | 38.518 | 25.697 | 70 |
| 52 | Suction-Side | 39.168 | 24.866 | 70 |
| 53 | Suction-Side | 39.792 | 24.016 | 70 |
| 54 | Suction-Side | 40.392 | 23.150 | 70 |
| 55 | Suction-Side | 40.971 | 22.269 | 70 |
| 56 | Suction-Side | 41.529 | 21.374 | 70 |
| 57 | Suction-Side | 42.069 | 20.469 | 70 |
| 58 | Suction-Side | 42.592 | 19.553 | 70 |
| 59 | Suction-Side | 43.098 | 18.629 | 70 |
| 60 | Suction-Side | 43.589 | 17.695 | 70 |
| 61 | Suction-Side | 44.067 | 16.756 | 70 |
| 62 | Suction-Side | 44.532 | 15.810 | 70 |
| 63 | Suction-Side | 44.986 | 14.859 | 70 |
| 64 | Suction-Side | 45.428 | 13.902 | 70 |
| 65 | Suction-Side | 45.861 | 12.941 | 70 |
| 66 | Suction-Side | 46.285 | 11.976 | 70 |
| 67 | Suction-Side | 46.701 | 11.007 | 70 |
| 68 | Suction-Side | 47.109 | 10.035 | 70 |
| 69 | Suction-Side | 47.511 | 9.060 | 70 |
| 70 | Suction-Side | 47.906 | 8.083 | 70 |
| 71 | Suction-Side | 48.295 | 7.103 | 70 |
| 72 | Suction-Side | 48.677 | 6.121 | 70 |
| 73 | Suction-Side | 49.056 | 5.137 | 70 |
| 74 | Suction-Side | 49.430 | 4.151 | 70 |
| 75 | Suction-Side | 49.798 | 3.164 | 70 |
| 76 | Suction-Side | 50.165 | 2.175 | 70 |
| 77 | Suction-Side | 50.526 | 1.184 | 70 |
| 78 | Suction-Side | 50.884 | 0.194 | 70 |
| 79 | Suction-Side | 51.239 | −0.799 | 70 |
| 80 | Suction-Side | 51.589 | −1.793 | 70 |
| 81 | Suction-Side | 51.938 | −2.789 | 70 |
| 82 | Suction-Side | 52.282 | −3.785 | 70 |
| 83 | Suction-Side | 52.623 | −4.782 | 70 |
| 84 | Suction-Side | 52.962 | −5.781 | 70 |
| 85 | Suction-Side | 53.298 | −6.780 | 70 |
| 86 | Suction-Side | 53.632 | −7.780 | 70 |
| 87 | Suction-Side | 53.963 | −8.780 | 70 |
| 88 | Suction-Side | 54.294 | −9.781 | 70 |
| 89 | Suction-Side | 54.626 | −10.783 | 70 |
| 90 | Suction-Side | 54.955 | −11.784 | 70 |
| 91 | Suction-Side | 55.283 | −12.786 | 70 |
| 92 | Suction-Side | 55.609 | −13.788 | 70 |
| 93 | Suction-Side | 55.935 | −14.791 | 70 |
| 94 | Suction-Side | 56.258 | −15.794 | 70 |
| 95 | Suction-Side | 56.578 | −16.798 | 70 |
| 96 | Suction-Side | 56.896 | −17.803 | 70 |
| 97 | Suction-Side | 57.212 | −18.809 | 70 |
| 98 | Suction-Side | 57.527 | −19.815 | 70 |
| 99 | Suction-Side | 57.839 | −20.823 | 70 |
| 100 | Suction-Side | 58.038 | −21.846 | 70 |
| 101 | Pressure-Side | 57.379 | −22.608 | 70 |
| 102 | Pressure-Side | 56.654 | −22.624 | 70 |
| 103 | Pressure-Side | 56.113 | −22.143 | 70 |
| 104 | Pressure-Side | 55.807 | −21.469 | 70 |

TABLE 1-continued

| N | Location | X | Y | Z |
|---|---|---|---|---|
| 105 | Pressure-Side | 55.503 | −20.794 | 70 |
| 106 | Pressure-Side | 55.199 | −20.118 | 70 |
| 107 | Pressure-Side | 54.895 | −19.442 | 70 |
| 108 | Pressure-Side | 54.591 | −18.767 | 70 |
| 109 | Pressure-Side | 54.287 | −18.091 | 70 |
| 110 | Pressure-Side | 53.983 | −17.415 | 70 |
| 111 | Pressure-Side | 53.679 | −16.741 | 70 |
| 112 | Pressure-Side | 53.376 | −16.065 | 70 |
| 113 | Pressure-Side | 53.071 | −15.390 | 70 |
| 114 | Pressure-Side | 52.767 | −14.715 | 70 |
| 115 | Pressure-Side | 52.460 | −14.040 | 70 |
| 116 | Pressure-Side | 52.154 | −13.366 | 70 |
| 117 | Pressure-Side | 51.847 | −12.691 | 70 |
| 118 | Pressure-Side | 51.538 | −12.019 | 70 |
| 119 | Pressure-Side | 51.228 | −11.345 | 70 |
| 120 | Pressure-Side | 50.917 | −10.674 | 70 |
| 121 | Pressure-Side | 50.604 | −10.003 | 70 |
| 122 | Pressure-Side | 50.288 | −9.333 | 70 |
| 123 | Pressure-Side | 49.970 | −8.664 | 70 |
| 124 | Pressure-Side | 49.648 | −7.996 | 70 |
| 125 | Pressure-Side | 49.324 | −7.330 | 70 |
| 126 | Pressure-Side | 48.996 | −6.666 | 70 |
| 127 | Pressure-Side | 48.664 | −6.003 | 70 |
| 128 | Pressure-Side | 48.328 | −5.344 | 70 |
| 129 | Pressure-Side | 47.988 | −4.686 | 70 |
| 130 | Pressure-Side | 47.643 | −4.031 | 70 |
| 131 | Pressure-Side | 47.292 | −3.377 | 70 |
| 132 | Pressure-Side | 46.937 | −2.728 | 70 |
| 133 | Pressure-Side | 46.575 | −2.082 | 70 |
| 134 | Pressure-Side | 46.208 | −1.438 | 70 |
| 135 | Pressure-Side | 45.834 | −0.799 | 70 |
| 136 | Pressure-Side | 45.453 | −0.164 | 70 |
| 137 | Pressure-Side | 45.067 | 0.468 | 70 |
| 138 | Pressure-Side | 44.672 | 1.095 | 70 |
| 139 | Pressure-Side | 44.269 | 1.717 | 70 |
| 140 | Pressure-Side | 43.859 | 2.333 | 70 |
| 141 | Pressure-Side | 43.439 | 2.943 | 70 |
| 142 | Pressure-Side | 43.010 | 3.547 | 70 |
| 143 | Pressure-Side | 42.571 | 4.144 | 70 |
| 144 | Pressure-Side | 42.121 | 4.733 | 70 |
| 145 | Pressure-Side | 41.662 | 5.313 | 70 |
| 146 | Pressure-Side | 41.189 | 5.884 | 70 |
| 147 | Pressure-Side | 40.706 | 6.445 | 70 |
| 148 | Pressure-Side | 40.210 | 6.994 | 70 |
| 149 | Pressure-Side | 39.700 | 7.531 | 70 |
| 150 | Pressure-Side | 39.177 | 8.056 | 70 |
| 151 | Pressure-Side | 38.640 | 8.566 | 70 |
| 152 | Pressure-Side | 38.089 | 9.061 | 70 |
| 153 | Pressure-Side | 37.524 | 9.540 | 70 |
| 154 | Pressure-Side | 36.944 | 10.002 | 70 |
| 155 | Pressure-Side | 36.350 | 10.443 | 70 |
| 156 | Pressure-Side | 35.741 | 10.864 | 70 |
| 157 | Pressure-Side | 35.118 | 11.265 | 70 |
| 158 | Pressure-Side | 34.480 | 11.643 | 70 |
| 159 | Pressure-Side | 33.829 | 11.996 | 70 |
| 160 | Pressure-Side | 33.165 | 12.325 | 70 |
| 161 | Pressure-Side | 32.490 | 12.628 | 70 |
| 162 | Pressure-Side | 31.803 | 12.904 | 70 |
| 163 | Pressure-Side | 31.104 | 13.152 | 70 |
| 164 | Pressure-Side | 30.397 | 13.371 | 70 |
| 165 | Pressure-Side | 29.682 | 13.562 | 70 |
| 166 | Pressure-Side | 28.959 | 13.722 | 70 |
| 167 | Pressure-Side | 28.229 | 13.853 | 70 |
| 168 | Pressure-Side | 27.496 | 13.954 | 70 |
| 169 | Pressure-Side | 26.759 | 14.025 | 70 |
| 170 | Pressure-Side | 26.020 | 14.067 | 70 |
| 171 | Pressure-Side | 25.279 | 14.080 | 70 |
| 172 | Pressure-Side | 24.539 | 14.063 | 70 |
| 173 | Pressure-Side | 23.799 | 14.019 | 70 |
| 174 | Pressure-Side | 23.061 | 13.948 | 70 |
| 175 | Pressure-Side | 22.328 | 13.851 | 70 |
| 176 | Pressure-Side | 21.597 | 13.731 | 70 |
| 177 | Pressure-Side | 20.871 | 13.586 | 70 |
| 178 | Pressure-Side | 20.149 | 13.418 | 70 |
| 179 | Pressure-Side | 19.432 | 13.231 | 70 |
| 180 | Pressure-Side | 18.721 | 13.024 | 70 |
| 181 | Pressure-Side | 18.015 | 12.800 | 70 |
| 182 | Pressure-Side | 17.314 | 12.561 | 70 |

TABLE 1-continued

| N | Location | X | Y | Z |
|---|---|---|---|---|
| 183 | Pressure-Side | 16.619 | 12.306 | 70 |
| 184 | Pressure-Side | 15.927 | 12.040 | 70 |
| 185 | Pressure-Side | 15.240 | 11.763 | 70 |
| 186 | Pressure-Side | 14.556 | 11.478 | 70 |
| 187 | Pressure-Side | 13.875 | 11.186 | 70 |
| 188 | Pressure-Side | 13.197 | 10.890 | 70 |
| 189 | Pressure-Side | 12.518 | 10.594 | 70 |
| 190 | Pressure-Side | 11.839 | 10.298 | 70 |
| 191 | Pressure-Side | 11.157 | 10.009 | 70 |
| 192 | Pressure-Side | 10.471 | 9.730 | 70 |
| 193 | Pressure-Side | 9.779 | 9.466 | 70 |
| 194 | Pressure-Side | 9.079 | 9.224 | 70 |
| 195 | Pressure-Side | 8.369 | 9.016 | 70 |
| 196 | Pressure-Side | 7.646 | 8.852 | 70 |
| 197 | Pressure-Side | 6.913 | 8.749 | 70 |
| 198 | Pressure-Side | 6.173 | 8.729 | 70 |
| 199 | Pressure-Side | 5.437 | 8.815 | 70 |
| 200 | Pressure-Side | 4.729 | 9.024 | 70 |
| 1 | Suction-Side | 4.735 | 11.772 | 80 |
| 2 | Suction-Side | 4.105 | 12.582 | 80 |
| 3 | Suction-Side | 3.803 | 13.572 | 80 |
| 4 | Suction-Side | 3.705 | 14.602 | 80 |
| 5 | Suction-Side | 3.741 | 15.638 | 80 |
| 6 | Suction-Side | 3.874 | 16.665 | 80 |
| 7 | Suction-Side | 4.082 | 17.681 | 80 |
| 8 | Suction-Side | 4.354 | 18.681 | 80 |
| 9 | Suction-Side | 4.680 | 19.666 | 80 |
| 10 | Suction-Side | 5.055 | 20.632 | 80 |
| 11 | Suction-Side | 5.475 | 21.580 | 80 |
| 12 | Suction-Side | 5.936 | 22.508 | 80 |
| 13 | Suction-Side | 6.436 | 23.416 | 80 |
| 14 | Suction-Side | 6.975 | 24.302 | 80 |
| 15 | Suction-Side | 7.550 | 25.164 | 80 |
| 16 | Suction-Side | 8.162 | 26.002 | 80 |
| 17 | Suction-Side | 8.808 | 26.813 | 80 |
| 18 | Suction-Side | 9.488 | 27.594 | 80 |
| 19 | Suction-Side | 10.204 | 28.344 | 80 |
| 20 | Suction-Side | 10.953 | 29.062 | 80 |
| 21 | Suction-Side | 11.735 | 29.742 | 80 |
| 22 | Suction-Side | 12.550 | 30.383 | 80 |
| 23 | Suction-Side | 13.396 | 30.981 | 80 |
| 24 | Suction-Side | 14.274 | 31.534 | 80 |
| 25 | Suction-Side | 15.181 | 32.035 | 80 |
| 26 | Suction-Side | 16.115 | 32.485 | 80 |
| 27 | Suction-Side | 17.074 | 32.876 | 80 |
| 28 | Suction-Side | 18.057 | 33.209 | 80 |
| 29 | Suction-Side | 19.058 | 33.477 | 80 |
| 30 | Suction-Side | 20.074 | 33.678 | 80 |
| 31 | Suction-Side | 21.103 | 33.812 | 80 |
| 32 | Suction-Side | 22.136 | 33.876 | 80 |
| 33 | Suction-Side | 23.173 | 33.870 | 80 |
| 34 | Suction-Side | 24.207 | 33.794 | 80 |
| 35 | Suction-Side | 25.234 | 33.649 | 80 |
| 36 | Suction-Side | 26.248 | 33.438 | 80 |
| 37 | Suction-Side | 27.247 | 33.162 | 80 |
| 38 | Suction-Side | 28.228 | 32.825 | 80 |
| 39 | Suction-Side | 29.186 | 32.429 | 80 |
| 40 | Suction-Side | 30.120 | 31.980 | 80 |
| 41 | Suction-Side | 31.028 | 31.479 | 80 |
| 42 | Suction-Side | 31.908 | 30.932 | 80 |
| 43 | Suction-Side | 32.761 | 30.342 | 80 |
| 44 | Suction-Side | 33.584 | 29.713 | 80 |
| 45 | Suction-Side | 34.379 | 29.046 | 80 |
| 46 | Suction-Side | 35.145 | 28.348 | 80 |
| 47 | Suction-Side | 35.884 | 27.620 | 80 |
| 48 | Suction-Side | 36.594 | 26.867 | 80 |
| 49 | Suction-Side | 37.280 | 26.088 | 80 |
| 50 | Suction-Side | 37.939 | 25.289 | 80 |
| 51 | Suction-Side | 38.575 | 24.469 | 80 |
| 52 | Suction-Side | 39.188 | 23.633 | 80 |
| 53 | Suction-Side | 39.780 | 22.782 | 80 |
| 54 | Suction-Side | 40.351 | 21.916 | 80 |
| 55 | Suction-Side | 40.904 | 21.039 | 80 |
| 56 | Suction-Side | 41.437 | 20.150 | 80 |
| 57 | Suction-Side | 41.955 | 19.253 | 80 |
| 58 | Suction-Side | 42.458 | 18.346 | 80 |
| 59 | Suction-Side | 42.946 | 17.431 | 80 |
| 60 | Suction-Side | 43.421 | 16.510 | 80 |

TABLE 1-continued

| N | Location | X | Y | Z |
|---|---|---|---|---|
| 61 | Suction-Side | 43.882 | 15.581 | 80 |
| 62 | Suction-Side | 44.334 | 14.648 | 80 |
| 63 | Suction-Side | 44.774 | 13.709 | 80 |
| 64 | Suction-Side | 45.204 | 12.766 | 80 |
| 65 | Suction-Side | 45.627 | 11.819 | 80 |
| 66 | Suction-Side | 46.041 | 10.869 | 80 |
| 67 | Suction-Side | 46.446 | 9.914 | 80 |
| 68 | Suction-Side | 46.846 | 8.957 | 80 |
| 69 | Suction-Side | 47.238 | 7.999 | 80 |
| 70 | Suction-Side | 47.626 | 7.037 | 80 |
| 71 | Suction-Side | 48.008 | 6.073 | 80 |
| 72 | Suction-Side | 48.383 | 5.106 | 80 |
| 73 | Suction-Side | 48.755 | 4.139 | 80 |
| 74 | Suction-Side | 49.124 | 3.169 | 80 |
| 75 | Suction-Side | 49.487 | 2.199 | 80 |
| 76 | Suction-Side | 49.849 | 1.226 | 80 |
| 77 | Suction-Side | 50.205 | 0.254 | 80 |
| 78 | Suction-Side | 50.559 | −0.721 | 80 |
| 79 | Suction-Side | 50.911 | −1.696 | 80 |
| 80 | Suction-Side | 51.259 | −2.673 | 80 |
| 81 | Suction-Side | 51.604 | −3.651 | 80 |
| 82 | Suction-Side | 51.946 | −4.630 | 80 |
| 83 | Suction-Side | 52.286 | −5.609 | 80 |
| 84 | Suction-Side | 52.622 | −6.590 | 80 |
| 85 | Suction-Side | 52.957 | −7.571 | 80 |
| 86 | Suction-Side | 53.291 | −8.553 | 80 |
| 87 | Suction-Side | 53.622 | −9.535 | 80 |
| 88 | Suction-Side | 53.955 | −10.517 | 80 |
| 89 | Suction-Side | 54.285 | −11.499 | 80 |
| 90 | Suction-Side | 54.616 | −12.482 | 80 |
| 91 | Suction-Side | 54.945 | −13.465 | 80 |
| 92 | Suction-Side | 55.274 | −14.448 | 80 |
| 93 | Suction-Side | 55.601 | −15.432 | 80 |
| 94 | Suction-Side | 55.927 | −16.416 | 80 |
| 95 | Suction-Side | 56.250 | −17.401 | 80 |
| 96 | Suction-Side | 56.573 | −18.387 | 80 |
| 97 | Suction-Side | 56.893 | −19.373 | 80 |
| 98 | Suction-Side | 57.212 | −20.360 | 80 |
| 99 | Suction-Side | 57.528 | −21.347 | 80 |
| 100 | Suction-Side | 57.736 | −22.352 | 80 |
| 101 | Pressure-Side | 57.097 | −23.108 | 80 |
| 102 | Pressure-Side | 56.378 | −23.128 | 80 |
| 103 | Pressure-Side | 55.845 | −22.649 | 80 |
| 104 | Pressure-Side | 55.535 | −21.984 | 80 |
| 105 | Pressure-Side | 55.225 | −21.319 | 80 |
| 106 | Pressure-Side | 54.914 | −20.654 | 80 |
| 107 | Pressure-Side | 54.602 | −19.990 | 80 |
| 108 | Pressure-Side | 54.288 | −19.326 | 80 |
| 109 | Pressure-Side | 53.974 | −18.663 | 80 |
| 110 | Pressure-Side | 53.658 | −18.000 | 80 |
| 111 | Pressure-Side | 53.342 | −17.338 | 80 |
| 112 | Pressure-Side | 53.026 | −16.675 | 80 |
| 113 | Pressure-Side | 52.709 | −16.013 | 80 |
| 114 | Pressure-Side | 52.392 | −15.352 | 80 |
| 115 | Pressure-Side | 52.074 | −14.690 | 80 |
| 116 | Pressure-Side | 51.756 | −14.029 | 80 |
| 117 | Pressure-Side | 51.435 | −13.368 | 80 |
| 118 | Pressure-Side | 51.114 | −12.708 | 80 |
| 119 | Pressure-Side | 50.794 | −12.047 | 80 |
| 120 | Pressure-Side | 50.471 | −11.388 | 80 |
| 121 | Pressure-Side | 50.145 | −10.730 | 80 |
| 122 | Pressure-Side | 49.820 | −10.072 | 80 |
| 123 | Pressure-Side | 49.492 | −9.415 | 80 |
| 124 | Pressure-Side | 49.162 | −8.760 | 80 |
| 125 | Pressure-Side | 48.829 | −8.105 | 80 |
| 126 | Pressure-Side | 48.494 | −7.452 | 80 |
| 127 | Pressure-Side | 48.156 | −6.801 | 80 |
| 128 | Pressure-Side | 47.815 | −6.152 | 80 |
| 129 | Pressure-Side | 47.470 | −5.503 | 80 |
| 130 | Pressure-Side | 47.121 | −4.857 | 80 |
| 131 | Pressure-Side | 46.768 | −4.214 | 80 |
| 132 | Pressure-Side | 46.412 | −3.572 | 80 |
| 133 | Pressure-Side | 46.050 | −2.933 | 80 |
| 134 | Pressure-Side | 45.684 | −2.297 | 80 |
| 135 | Pressure-Side | 45.315 | −1.663 | 80 |
| 136 | Pressure-Side | 44.939 | −1.032 | 80 |
| 137 | Pressure-Side | 44.557 | −0.404 | 80 |
| 138 | Pressure-Side | 44.172 | 0.219 | 80 |

TABLE 1-continued

| N | Location | X | Y | Z |
|---|---|---|---|---|
| 139 | Pressure-Side | 43.780 | 0.840 | 80 |
| 140 | Pressure-Side | 43.381 | 1.456 | 80 |
| 141 | Pressure-Side | 42.976 | 2.069 | 80 |
| 142 | Pressure-Side | 42.563 | 2.675 | 80 |
| 143 | Pressure-Side | 42.143 | 3.278 | 80 |
| 144 | Pressure-Side | 41.716 | 3.874 | 80 |
| 145 | Pressure-Side | 41.279 | 4.465 | 80 |
| 146 | Pressure-Side | 40.834 | 5.049 | 80 |
| 147 | Pressure-Side | 40.380 | 5.624 | 80 |
| 148 | Pressure-Side | 39.915 | 6.194 | 80 |
| 149 | Pressure-Side | 39.442 | 6.753 | 80 |
| 150 | Pressure-Side | 38.957 | 7.305 | 80 |
| 151 | Pressure-Side | 38.462 | 7.847 | 80 |
| 152 | Pressure-Side | 37.955 | 8.378 | 80 |
| 153 | Pressure-Side | 37.436 | 8.897 | 80 |
| 154 | Pressure-Side | 36.907 | 9.405 | 80 |
| 155 | Pressure-Side | 36.363 | 9.899 | 80 |
| 156 | Pressure-Side | 35.807 | 10.378 | 80 |
| 157 | Pressure-Side | 35.239 | 10.843 | 80 |
| 158 | Pressure-Side | 34.657 | 11.290 | 80 |
| 159 | Pressure-Side | 34.063 | 11.721 | 80 |
| 160 | Pressure-Side | 33.455 | 12.131 | 80 |
| 161 | Pressure-Side | 32.833 | 12.522 | 80 |
| 162 | Pressure-Side | 32.200 | 12.893 | 80 |
| 163 | Pressure-Side | 31.553 | 13.240 | 80 |
| 164 | Pressure-Side | 30.894 | 13.563 | 80 |
| 165 | Pressure-Side | 30.224 | 13.862 | 80 |
| 166 | Pressure-Side | 29.542 | 14.134 | 80 |
| 167 | Pressure-Side | 28.850 | 14.379 | 80 |
| 168 | Pressure-Side | 28.148 | 14.596 | 80 |
| 169 | Pressure-Side | 27.439 | 14.782 | 80 |
| 170 | Pressure-Side | 26.722 | 14.940 | 80 |
| 171 | Pressure-Side | 25.999 | 15.068 | 80 |
| 172 | Pressure-Side | 25.272 | 15.166 | 80 |
| 173 | Pressure-Side | 24.541 | 15.233 | 80 |
| 174 | Pressure-Side | 23.808 | 15.270 | 80 |
| 175 | Pressure-Side | 23.074 | 15.279 | 80 |
| 176 | Pressure-Side | 22.340 | 15.258 | 80 |
| 177 | Pressure-Side | 21.607 | 15.209 | 80 |
| 178 | Pressure-Side | 20.878 | 15.135 | 80 |
| 179 | Pressure-Side | 20.150 | 15.036 | 80 |
| 180 | Pressure-Side | 19.426 | 14.911 | 80 |
| 181 | Pressure-Side | 18.707 | 14.765 | 80 |
| 182 | Pressure-Side | 17.992 | 14.599 | 80 |
| 183 | Pressure-Side | 17.283 | 14.415 | 80 |
| 184 | Pressure-Side | 16.577 | 14.212 | 80 |
| 185 | Pressure-Side | 15.876 | 13.995 | 80 |
| 186 | Pressure-Side | 15.179 | 13.764 | 80 |
| 187 | Pressure-Side | 14.486 | 13.521 | 80 |
| 188 | Pressure-Side | 13.796 | 13.270 | 80 |
| 189 | Pressure-Side | 13.109 | 13.013 | 80 |
| 190 | Pressure-Side | 12.423 | 12.751 | 80 |
| 191 | Pressure-Side | 11.737 | 12.489 | 80 |
| 192 | Pressure-Side | 11.051 | 12.229 | 80 |
| 193 | Pressure-Side | 10.362 | 11.977 | 80 |
| 194 | Pressure-Side | 9.668 | 11.737 | 80 |
| 195 | Pressure-Side | 8.967 | 11.522 | 80 |
| 196 | Pressure-Side | 8.256 | 11.339 | 80 |
| 197 | Pressure-Side | 7.533 | 11.205 | 80 |
| 198 | Pressure-Side | 6.803 | 11.146 | 80 |
| 199 | Pressure-Side | 6.072 | 11.200 | 80 |
| 200 | Pressure-Side | 5.368 | 11.405 | 80 |
| 1 | Suction-Side | 5.063 | 15.481 | 90 |
| 2 | Suction-Side | 4.525 | 16.322 | 90 |
| 3 | Suction-Side | 4.296 | 17.301 | 90 |
| 4 | Suction-Side | 4.267 | 18.306 | 90 |
| 5 | Suction-Side | 4.373 | 19.307 | 90 |
| 6 | Suction-Side | 4.575 | 20.293 | 90 |
| 7 | Suction-Side | 4.854 | 21.261 | 90 |
| 8 | Suction-Side | 5.197 | 22.207 | 90 |
| 9 | Suction-Side | 5.595 | 23.132 | 90 |
| 10 | Suction-Side | 6.043 | 24.034 | 90 |
| 11 | Suction-Side | 6.536 | 24.912 | 90 |
| 12 | Suction-Side | 7.070 | 25.765 | 90 |
| 13 | Suction-Side | 7.646 | 26.591 | 90 |
| 14 | Suction-Side | 8.258 | 27.389 | 90 |
| 15 | Suction-Side | 8.908 | 28.159 | 90 |
| 16 | Suction-Side | 9.594 | 28.897 | 90 |

TABLE 1-continued

| N | Location | X | Y | Z |
|---|---|---|---|---|
| 17 | Suction-Side | 10.315 | 29.599 | 90 |
| 18 | Suction-Side | 11.069 | 30.266 | 90 |
| 19 | Suction-Side | 11.857 | 30.892 | 90 |
| 20 | Suction-Side | 12.678 | 31.476 | 90 |
| 21 | Suction-Side | 13.528 | 32.015 | 90 |
| 22 | Suction-Side | 14.409 | 32.504 | 90 |
| 23 | Suction-Side | 15.317 | 32.939 | 90 |
| 24 | Suction-Side | 16.249 | 33.319 | 90 |
| 25 | Suction-Side | 17.204 | 33.638 | 90 |
| 26 | Suction-Side | 18.177 | 33.895 | 90 |
| 27 | Suction-Side | 19.166 | 34.087 | 90 |
| 28 | Suction-Side | 20.165 | 34.212 | 90 |
| 29 | Suction-Side | 21.170 | 34.269 | 90 |
| 30 | Suction-Side | 22.177 | 34.257 | 90 |
| 31 | Suction-Side | 23.181 | 34.176 | 90 |
| 32 | Suction-Side | 24.176 | 34.028 | 90 |
| 33 | Suction-Side | 25.161 | 33.816 | 90 |
| 34 | Suction-Side | 26.129 | 33.541 | 90 |
| 35 | Suction-Side | 27.078 | 33.207 | 90 |
| 36 | Suction-Side | 28.008 | 32.817 | 90 |
| 37 | Suction-Side | 28.912 | 32.377 | 90 |
| 38 | Suction-Side | 29.793 | 31.889 | 90 |
| 39 | Suction-Side | 30.648 | 31.357 | 90 |
| 40 | Suction-Side | 31.476 | 30.785 | 90 |
| 41 | Suction-Side | 32.279 | 30.176 | 90 |
| 42 | Suction-Side | 33.055 | 29.535 | 90 |
| 43 | Suction-Side | 33.806 | 28.863 | 90 |
| 44 | Suction-Side | 34.531 | 28.165 | 90 |
| 45 | Suction-Side | 35.232 | 27.441 | 90 |
| 46 | Suction-Side | 35.909 | 26.697 | 90 |
| 47 | Suction-Side | 36.563 | 25.931 | 90 |
| 48 | Suction-Side | 37.196 | 25.147 | 90 |
| 49 | Suction-Side | 37.809 | 24.348 | 90 |
| 50 | Suction-Side | 38.401 | 23.534 | 90 |
| 51 | Suction-Side | 38.974 | 22.707 | 90 |
| 52 | Suction-Side | 39.530 | 21.867 | 90 |
| 53 | Suction-Side | 40.068 | 21.015 | 90 |
| 54 | Suction-Side | 40.591 | 20.155 | 90 |
| 55 | Suction-Side | 41.100 | 19.285 | 90 |
| 56 | Suction-Side | 41.593 | 18.408 | 90 |
| 57 | Suction-Side | 42.074 | 17.523 | 90 |
| 58 | Suction-Side | 42.543 | 16.632 | 90 |
| 59 | Suction-Side | 43.001 | 15.735 | 90 |
| 60 | Suction-Side | 43.447 | 14.832 | 90 |
| 61 | Suction-Side | 43.885 | 13.926 | 90 |
| 62 | Suction-Side | 44.313 | 13.014 | 90 |
| 63 | Suction-Side | 44.733 | 12.099 | 90 |
| 64 | Suction-Side | 45.146 | 11.180 | 90 |
| 65 | Suction-Side | 45.551 | 10.259 | 90 |
| 66 | Suction-Side | 45.950 | 9.334 | 90 |
| 67 | Suction-Side | 46.342 | 8.407 | 90 |
| 68 | Suction-Side | 46.730 | 7.477 | 90 |
| 69 | Suction-Side | 47.111 | 6.545 | 90 |
| 70 | Suction-Side | 47.488 | 5.612 | 90 |
| 71 | Suction-Side | 47.862 | 4.677 | 90 |
| 72 | Suction-Side | 48.230 | 3.739 | 90 |
| 73 | Suction-Side | 48.595 | 2.801 | 90 |
| 74 | Suction-Side | 48.956 | 1.860 | 90 |
| 75 | Suction-Side | 49.314 | 0.919 | 90 |
| 76 | Suction-Side | 49.668 | −0.024 | 90 |
| 77 | Suction-Side | 50.020 | −0.967 | 90 |
| 78 | Suction-Side | 50.368 | −1.912 | 90 |
| 79 | Suction-Side | 50.714 | −2.857 | 90 |
| 80 | Suction-Side | 51.057 | −3.804 | 90 |
| 81 | Suction-Side | 51.397 | −4.752 | 90 |
| 82 | Suction-Side | 51.734 | −5.701 | 90 |
| 83 | Suction-Side | 52.069 | −6.651 | 90 |
| 84 | Suction-Side | 52.402 | −7.602 | 90 |
| 85 | Suction-Side | 52.732 | −8.553 | 90 |
| 86 | Suction-Side | 53.061 | −9.504 | 90 |
| 87 | Suction-Side | 53.390 | −10.456 | 90 |
| 88 | Suction-Side | 53.718 | −11.408 | 90 |
| 89 | Suction-Side | 54.044 | −12.361 | 90 |
| 90 | Suction-Side | 54.372 | −13.313 | 90 |
| 91 | Suction-Side | 54.698 | −14.265 | 90 |
| 92 | Suction-Side | 55.023 | −15.219 | 90 |
| 93 | Suction-Side | 55.347 | −16.172 | 90 |
| 94 | Suction-Side | 55.670 | −17.126 | 90 |

TABLE 1-continued

| N | Location | X | Y | Z |
|---|---|---|---|---|
| 95 | Suction-Side | 55.991 | −18.081 | 90 |
| 96 | Suction-Side | 56.310 | −19.035 | 90 |
| 97 | Suction-Side | 56.627 | −19.991 | 90 |
| 98 | Suction-Side | 56.943 | −20.947 | 90 |
| 99 | Suction-Side | 57.258 | −21.904 | 90 |
| 100 | Suction-Side | 57.452 | −22.880 | 90 |
| 101 | Pressure-Side | 56.826 | −23.614 | 90 |
| 102 | Pressure-Side | 56.112 | −23.636 | 90 |
| 103 | Pressure-Side | 55.578 | −23.163 | 90 |
| 104 | Pressure-Side | 55.266 | −22.502 | 90 |
| 105 | Pressure-Side | 54.951 | −21.842 | 90 |
| 106 | Pressure-Side | 54.635 | −21.183 | 90 |
| 107 | Pressure-Side | 54.318 | −20.525 | 90 |
| 108 | Pressure-Side | 53.999 | −19.867 | 90 |
| 109 | Pressure-Side | 53.677 | −19.210 | 90 |
| 110 | Pressure-Side | 53.354 | −18.554 | 90 |
| 111 | Pressure-Side | 53.031 | −17.900 | 90 |
| 112 | Pressure-Side | 52.706 | −17.244 | 90 |
| 113 | Pressure-Side | 52.380 | −16.590 | 90 |
| 114 | Pressure-Side | 52.054 | −15.937 | 90 |
| 115 | Pressure-Side | 51.726 | −15.283 | 90 |
| 116 | Pressure-Side | 51.398 | −14.630 | 90 |
| 117 | Pressure-Side | 51.068 | −13.977 | 90 |
| 118 | Pressure-Side | 50.738 | −13.326 | 90 |
| 119 | Pressure-Side | 50.406 | −12.674 | 90 |
| 120 | Pressure-Side | 50.072 | −12.023 | 90 |
| 121 | Pressure-Side | 49.739 | −11.374 | 90 |
| 122 | Pressure-Side | 49.402 | −10.724 | 90 |
| 123 | Pressure-Side | 49.065 | −10.076 | 90 |
| 124 | Pressure-Side | 48.725 | −9.429 | 90 |
| 125 | Pressure-Side | 48.384 | −8.782 | 90 |
| 126 | Pressure-Side | 48.041 | −8.138 | 90 |
| 127 | Pressure-Side | 47.695 | −7.493 | 90 |
| 128 | Pressure-Side | 47.346 | −6.852 | 90 |
| 129 | Pressure-Side | 46.995 | −6.210 | 90 |
| 130 | Pressure-Side | 46.640 | −5.571 | 90 |
| 131 | Pressure-Side | 46.282 | −4.934 | 90 |
| 132 | Pressure-Side | 45.921 | −4.299 | 90 |
| 133 | Pressure-Side | 45.557 | −3.664 | 90 |
| 134 | Pressure-Side | 45.189 | −3.033 | 90 |
| 135 | Pressure-Side | 44.817 | −2.403 | 90 |
| 136 | Pressure-Side | 44.441 | −1.777 | 90 |
| 137 | Pressure-Side | 44.062 | −1.152 | 90 |
| 138 | Pressure-Side | 43.678 | −0.530 | 90 |
| 139 | Pressure-Side | 43.289 | 0.089 | 90 |
| 140 | Pressure-Side | 42.895 | 0.705 | 90 |
| 141 | Pressure-Side | 42.497 | 1.317 | 90 |
| 142 | Pressure-Side | 42.093 | 1.926 | 90 |
| 143 | Pressure-Side | 41.684 | 2.531 | 90 |
| 144 | Pressure-Side | 41.267 | 3.133 | 90 |
| 145 | Pressure-Side | 40.845 | 3.729 | 90 |
| 146 | Pressure-Side | 40.417 | 4.321 | 90 |
| 147 | Pressure-Side | 39.980 | 4.907 | 90 |
| 148 | Pressure-Side | 39.536 | 5.489 | 90 |
| 149 | Pressure-Side | 39.085 | 6.063 | 90 |
| 150 | Pressure-Side | 38.626 | 6.631 | 90 |
| 151 | Pressure-Side | 38.157 | 7.193 | 90 |
| 152 | Pressure-Side | 37.679 | 7.746 | 90 |
| 153 | Pressure-Side | 37.192 | 8.291 | 90 |
| 154 | Pressure-Side | 36.696 | 8.828 | 90 |
| 155 | Pressure-Side | 36.190 | 9.354 | 90 |
| 156 | Pressure-Side | 35.672 | 9.871 | 90 |
| 157 | Pressure-Side | 35.144 | 10.376 | 90 |
| 158 | Pressure-Side | 34.605 | 10.869 | 90 |
| 159 | Pressure-Side | 34.053 | 11.350 | 90 |
| 160 | Pressure-Side | 33.490 | 11.815 | 90 |
| 161 | Pressure-Side | 32.915 | 12.266 | 90 |
| 162 | Pressure-Side | 32.327 | 12.701 | 90 |
| 163 | Pressure-Side | 31.727 | 13.118 | 90 |
| 164 | Pressure-Side | 31.115 | 13.516 | 90 |
| 165 | Pressure-Side | 30.489 | 13.896 | 90 |
| 166 | Pressure-Side | 29.853 | 14.255 | 90 |
| 167 | Pressure-Side | 29.204 | 14.591 | 90 |
| 168 | Pressure-Side | 28.544 | 14.904 | 90 |
| 169 | Pressure-Side | 27.873 | 15.193 | 90 |
| 170 | Pressure-Side | 27.191 | 15.457 | 90 |
| 171 | Pressure-Side | 26.501 | 15.696 | 90 |
| 172 | Pressure-Side | 25.801 | 15.908 | 90 |

TABLE 1-continued

| N | Location | X | Y | Z |
|---|---|---|---|---|
| 173 | Pressure-Side | 25.094 | 16.093 | 90 |
| 174 | Pressure-Side | 24.381 | 16.251 | 90 |
| 175 | Pressure-Side | 23.662 | 16.383 | 90 |
| 176 | Pressure-Side | 22.938 | 16.487 | 90 |
| 177 | Pressure-Side | 22.210 | 16.566 | 90 |
| 178 | Pressure-Side | 21.482 | 16.617 | 90 |
| 179 | Pressure-Side | 20.752 | 16.644 | 90 |
| 180 | Pressure-Side | 20.021 | 16.646 | 90 |
| 181 | Pressure-Side | 19.290 | 16.625 | 90 |
| 182 | Pressure-Side | 18.560 | 16.582 | 90 |
| 183 | Pressure-Side | 17.833 | 16.517 | 90 |
| 184 | Pressure-Side | 17.107 | 16.433 | 90 |
| 185 | Pressure-Side | 16.383 | 16.333 | 90 |
| 186 | Pressure-Side | 15.662 | 16.214 | 90 |
| 187 | Pressure-Side | 14.943 | 16.083 | 90 |
| 188 | Pressure-Side | 14.226 | 15.938 | 90 |
| 189 | Pressure-Side | 13.512 | 15.784 | 90 |
| 190 | Pressure-Side | 12.799 | 15.622 | 90 |
| 191 | Pressure-Side | 12.087 | 15.456 | 90 |
| 192 | Pressure-Side | 11.375 | 15.287 | 90 |
| 193 | Pressure-Side | 10.663 | 15.123 | 90 |
| 194 | Pressure-Side | 9.949 | 14.968 | 90 |
| 195 | Pressure-Side | 9.231 | 14.830 | 90 |
| 196 | Pressure-Side | 8.509 | 14.721 | 90 |
| 197 | Pressure-Side | 7.781 | 14.658 | 90 |
| 198 | Pressure-Side | 7.050 | 14.667 | 90 |
| 199 | Pressure-Side | 6.330 | 14.783 | 90 |
| 200 | Pressure-Side | 5.650 | 15.050 | 90 |
| 1 | Suction-Side | 5.256 | 20.028 | 100 |
| 2 | Suction-Side | 4.795 | 20.885 | 100 |
| 3 | Suction-Side | 4.650 | 21.850 | 100 |
| 4 | Suction-Side | 4.717 | 22.827 | 100 |
| 5 | Suction-Side | 4.927 | 23.782 | 100 |
| 6 | Suction-Side | 5.239 | 24.710 | 100 |
| 7 | Suction-Side | 5.630 | 25.608 | 100 |
| 8 | Suction-Side | 6.087 | 26.473 | 100 |
| 9 | Suction-Side | 6.600 | 27.308 | 100 |
| 10 | Suction-Side | 7.163 | 28.110 | 100 |
| 11 | Suction-Side | 7.768 | 28.879 | 100 |
| 12 | Suction-Side | 8.415 | 29.615 | 100 |
| 13 | Suction-Side | 9.100 | 30.316 | 100 |
| 14 | Suction-Side | 9.820 | 30.979 | 100 |
| 15 | Suction-Side | 10.573 | 31.603 | 100 |
| 16 | Suction-Side | 11.359 | 32.188 | 100 |
| 17 | Suction-Side | 12.177 | 32.728 | 100 |
| 18 | Suction-Side | 13.022 | 33.222 | 100 |
| 19 | Suction-Side | 13.896 | 33.666 | 100 |
| 20 | Suction-Side | 14.794 | 34.056 | 100 |
| 21 | Suction-Side | 15.714 | 34.389 | 100 |
| 22 | Suction-Side | 16.655 | 34.665 | 100 |
| 23 | Suction-Side | 17.609 | 34.877 | 100 |
| 24 | Suction-Side | 18.578 | 35.026 | 100 |
| 25 | Suction-Side | 19.553 | 35.110 | 100 |
| 26 | Suction-Side | 20.532 | 35.126 | 100 |
| 27 | Suction-Side | 21.511 | 35.075 | 100 |
| 28 | Suction-Side | 22.483 | 34.958 | 100 |
| 29 | Suction-Side | 23.445 | 34.777 | 100 |
| 30 | Suction-Side | 24.394 | 34.533 | 100 |
| 31 | Suction-Side | 25.325 | 34.229 | 100 |
| 32 | Suction-Side | 26.236 | 33.871 | 100 |
| 33 | Suction-Side | 27.125 | 33.462 | 100 |
| 34 | Suction-Side | 27.991 | 33.004 | 100 |
| 35 | Suction-Side | 28.833 | 32.504 | 100 |
| 36 | Suction-Side | 29.649 | 31.963 | 100 |
| 37 | Suction-Side | 30.441 | 31.387 | 100 |
| 38 | Suction-Side | 31.208 | 30.776 | 100 |
| 39 | Suction-Side | 31.950 | 30.138 | 100 |
| 40 | Suction-Side | 32.669 | 29.472 | 100 |
| 41 | Suction-Side | 33.364 | 28.782 | 100 |
| 42 | Suction-Side | 34.036 | 28.070 | 100 |
| 43 | Suction-Side | 34.688 | 27.339 | 100 |
| 44 | Suction-Side | 35.320 | 26.590 | 100 |
| 45 | Suction-Side | 35.931 | 25.826 | 100 |
| 46 | Suction-Side | 36.525 | 25.047 | 100 |
| 47 | Suction-Side | 37.100 | 24.254 | 100 |
| 48 | Suction-Side | 37.659 | 23.450 | 100 |
| 49 | Suction-Side | 38.202 | 22.635 | 100 |
| 50 | Suction-Side | 38.731 | 21.810 | 100 |

TABLE 1-continued

| N | Location | X | Y | Z |
|---|---|---|---|---|
| 51 | Suction-Side | 39.245 | 20.977 | 100 |
| 52 | Suction-Side | 39.747 | 20.135 | 100 |
| 53 | Suction-Side | 40.235 | 19.287 | 100 |
| 54 | Suction-Side | 40.712 | 18.431 | 100 |
| 55 | Suction-Side | 41.179 | 17.570 | 100 |
| 56 | Suction-Side | 41.636 | 16.704 | 100 |
| 57 | Suction-Side | 42.083 | 15.833 | 100 |
| 58 | Suction-Side | 42.522 | 14.957 | 100 |
| 59 | Suction-Side | 42.953 | 14.076 | 100 |
| 60 | Suction-Side | 43.375 | 13.193 | 100 |
| 61 | Suction-Side | 43.793 | 12.307 | 100 |
| 62 | Suction-Side | 44.202 | 11.418 | 100 |
| 63 | Suction-Side | 44.606 | 10.526 | 100 |
| 64 | Suction-Side | 45.006 | 9.631 | 100 |
| 65 | Suction-Side | 45.399 | 8.735 | 100 |
| 66 | Suction-Side | 45.789 | 7.836 | 100 |
| 67 | Suction-Side | 46.175 | 6.935 | 100 |
| 68 | Suction-Side | 46.555 | 6.033 | 100 |
| 69 | Suction-Side | 46.932 | 5.129 | 100 |
| 70 | Suction-Side | 47.306 | 4.223 | 100 |
| 71 | Suction-Side | 47.676 | 3.316 | 100 |
| 72 | Suction-Side | 48.042 | 2.408 | 100 |
| 73 | Suction-Side | 48.405 | 1.498 | 100 |
| 74 | Suction-Side | 48.765 | 0.587 | 100 |
| 75 | Suction-Side | 49.121 | −0.325 | 100 |
| 76 | Suction-Side | 49.474 | −1.238 | 100 |
| 77 | Suction-Side | 49.826 | −2.152 | 100 |
| 78 | Suction-Side | 50.173 | −3.069 | 100 |
| 79 | Suction-Side | 50.519 | −3.985 | 100 |
| 80 | Suction-Side | 50.860 | −4.903 | 100 |
| 81 | Suction-Side | 51.199 | −5.821 | 100 |
| 82 | Suction-Side | 51.534 | −6.741 | 100 |
| 83 | Suction-Side | 51.868 | −7.663 | 100 |
| 84 | Suction-Side | 52.198 | −8.585 | 100 |
| 85 | Suction-Side | 52.526 | −9.507 | 100 |
| 86 | Suction-Side | 52.853 | −10.431 | 100 |
| 87 | Suction-Side | 53.178 | −11.355 | 100 |
| 88 | Suction-Side | 53.504 | −12.279 | 100 |
| 89 | Suction-Side | 53.829 | −13.203 | 100 |
| 90 | Suction-Side | 54.153 | −14.127 | 100 |
| 91 | Suction-Side | 54.476 | −15.051 | 100 |
| 92 | Suction-Side | 54.798 | −15.976 | 100 |
| 93 | Suction-Side | 55.120 | −16.902 | 100 |
| 94 | Suction-Side | 55.439 | −17.828 | 100 |
| 95 | Suction-Side | 55.758 | −18.754 | 100 |
| 96 | Suction-Side | 56.073 | −19.681 | 100 |
| 97 | Suction-Side | 56.388 | −20.608 | 100 |
| 98 | Suction-Side | 56.700 | −21.537 | 100 |
| 99 | Suction-Side | 57.011 | −22.465 | 100 |
| 100 | Suction-Side | 57.187 | −23.415 | 100 |
| 101 | Pressure-Side | 56.569 | −24.125 | 100 |
| 102 | Pressure-Side | 55.852 | −24.152 | 100 |
| 103 | Pressure-Side | 55.314 | −23.678 | 100 |
| 104 | Pressure-Side | 54.997 | −23.018 | 100 |
| 105 | Pressure-Side | 54.680 | −22.358 | 100 |
| 106 | Pressure-Side | 54.359 | −21.697 | 100 |
| 107 | Pressure-Side | 54.036 | −21.039 | 100 |
| 108 | Pressure-Side | 53.711 | −20.382 | 100 |
| 109 | Pressure-Side | 53.383 | −19.726 | 100 |
| 110 | Pressure-Side | 53.054 | −19.071 | 100 |
| 111 | Pressure-Side | 52.722 | −18.417 | 100 |
| 112 | Pressure-Side | 52.389 | −17.764 | 100 |
| 113 | Pressure-Side | 52.055 | −17.112 | 100 |
| 114 | Pressure-Side | 51.719 | −16.460 | 100 |
| 115 | Pressure-Side | 51.381 | −15.809 | 100 |
| 116 | Pressure-Side | 51.042 | −15.158 | 100 |
| 117 | Pressure-Side | 50.702 | −14.508 | 100 |
| 118 | Pressure-Side | 50.360 | −13.860 | 100 |
| 119 | Pressure-Side | 50.016 | −13.211 | 100 |
| 120 | Pressure-Side | 49.672 | −12.565 | 100 |
| 121 | Pressure-Side | 49.326 | −11.918 | 100 |
| 122 | Pressure-Side | 48.978 | −11.273 | 100 |
| 123 | Pressure-Side | 48.628 | −10.628 | 100 |
| 124 | Pressure-Side | 48.277 | −9.985 | 100 |
| 125 | Pressure-Side | 47.924 | −9.342 | 100 |
| 126 | Pressure-Side | 47.568 | −8.701 | 100 |
| 127 | Pressure-Side | 47.210 | −8.061 | 100 |
| 128 | Pressure-Side | 46.849 | −7.422 | 100 |

TABLE 1-continued

| N | Location | X | Y | Z |
|---|---|---|---|---|
| 129 | Pressure-Side | 46.487 | −6.786 | 100 |
| 130 | Pressure-Side | 46.121 | −6.149 | 100 |
| 131 | Pressure-Side | 45.752 | −5.516 | 100 |
| 132 | Pressure-Side | 45.380 | −4.884 | 100 |
| 133 | Pressure-Side | 45.006 | −4.253 | 100 |
| 134 | Pressure-Side | 44.629 | −3.625 | 100 |
| 135 | Pressure-Side | 44.249 | −2.998 | 100 |
| 136 | Pressure-Side | 43.865 | −2.372 | 100 |
| 137 | Pressure-Side | 43.477 | −1.750 | 100 |
| 138 | Pressure-Side | 43.087 | −1.129 | 100 |
| 139 | Pressure-Side | 42.692 | −0.512 | 100 |
| 140 | Pressure-Side | 42.294 | 0.104 | 100 |
| 141 | Pressure-Side | 41.891 | 0.717 | 100 |
| 142 | Pressure-Side | 41.484 | 1.327 | 100 |
| 143 | Pressure-Side | 41.071 | 1.933 | 100 |
| 144 | Pressure-Side | 40.655 | 2.536 | 100 |
| 145 | Pressure-Side | 40.231 | 3.136 | 100 |
| 146 | Pressure-Side | 39.804 | 3.730 | 100 |
| 147 | Pressure-Side | 39.370 | 4.321 | 100 |
| 148 | Pressure-Side | 38.930 | 4.909 | 100 |
| 149 | Pressure-Side | 38.483 | 5.490 | 100 |
| 150 | Pressure-Side | 38.030 | 6.067 | 100 |
| 151 | Pressure-Side | 37.570 | 6.637 | 100 |
| 152 | Pressure-Side | 37.103 | 7.202 | 100 |
| 153 | Pressure-Side | 36.628 | 7.761 | 100 |
| 154 | Pressure-Side | 36.144 | 8.312 | 100 |
| 155 | Pressure-Side | 35.654 | 8.857 | 100 |
| 156 | Pressure-Side | 35.154 | 9.394 | 100 |
| 157 | Pressure-Side | 34.645 | 9.923 | 100 |
| 158 | Pressure-Side | 34.129 | 10.442 | 100 |
| 159 | Pressure-Side | 33.602 | 10.953 | 100 |
| 160 | Pressure-Side | 33.065 | 11.453 | 100 |
| 161 | Pressure-Side | 32.519 | 11.942 | 100 |
| 162 | Pressure-Side | 31.963 | 12.419 | 100 |
| 163 | Pressure-Side | 31.397 | 12.886 | 100 |
| 164 | Pressure-Side | 30.821 | 13.338 | 100 |
| 165 | Pressure-Side | 30.233 | 13.778 | 100 |
| 166 | Pressure-Side | 29.636 | 14.203 | 100 |
| 167 | Pressure-Side | 29.028 | 14.614 | 100 |
| 168 | Pressure-Side | 28.410 | 15.008 | 100 |
| 169 | Pressure-Side | 27.782 | 15.385 | 100 |
| 170 | Pressure-Side | 27.143 | 15.745 | 100 |
| 171 | Pressure-Side | 26.495 | 16.087 | 100 |
| 172 | Pressure-Side | 25.837 | 16.412 | 100 |
| 173 | Pressure-Side | 25.169 | 16.716 | 100 |
| 174 | Pressure-Side | 24.493 | 16.999 | 100 |
| 175 | Pressure-Side | 23.809 | 17.263 | 100 |
| 176 | Pressure-Side | 23.117 | 17.506 | 100 |
| 177 | Pressure-Side | 22.419 | 17.728 | 100 |
| 178 | Pressure-Side | 21.713 | 17.929 | 100 |
| 179 | Pressure-Side | 21.002 | 18.108 | 100 |
| 180 | Pressure-Side | 20.287 | 18.266 | 100 |
| 181 | Pressure-Side | 19.566 | 18.404 | 100 |
| 182 | Pressure-Side | 18.843 | 18.521 | 100 |
| 183 | Pressure-Side | 18.115 | 18.618 | 100 |
| 184 | Pressure-Side | 17.387 | 18.697 | 100 |
| 185 | Pressure-Side | 16.656 | 18.757 | 100 |
| 186 | Pressure-Side | 15.924 | 18.798 | 100 |
| 187 | Pressure-Side | 15.191 | 18.826 | 100 |
| 188 | Pressure-Side | 14.458 | 18.840 | 100 |
| 189 | Pressure-Side | 13.725 | 18.840 | 100 |
| 190 | Pressure-Side | 12.991 | 18.831 | 100 |
| 191 | Pressure-Side | 12.258 | 18.813 | 100 |
| 192 | Pressure-Side | 11.526 | 18.791 | 100 |
| 193 | Pressure-Side | 10.792 | 18.771 | 100 |
| 194 | Pressure-Side | 10.059 | 18.757 | 100 |
| 195 | Pressure-Side | 9.326 | 18.757 | 100 |
| 196 | Pressure-Side | 8.593 | 18.782 | 100 |
| 197 | Pressure-Side | 7.862 | 18.846 | 100 |
| 198 | Pressure-Side | 7.141 | 18.972 | 100 |
| 199 | Pressure-Side | 6.441 | 19.191 | 100 |
| 200 | Pressure-Side | 5.798 | 19.537 | 100 |

It will also be appreciated that the airfoil 250 disclosed in the above Table 1 may be scaled up or down geometrically for use in other similar turbine designs. Consequently, the coordinate values set forth in Table 1 may be scaled upwardly or downwardly such that the airfoil profile shape remains unchanged. A scaled version of the coordinates in Table 1 would be represented by X, Y and Z coordinate values of Table 1, with the X, Y and Z non-dimensional coordinate values converted to inches, multiplied or divided by a constant number.

An important term in this disclosure is profile. The profile is the range of the variation between measured points on an airfoil surface and the ideal position listed in Table 1. The actual profile on a manufactured blade will be different than those in Table 1 and the design is robust to this variation meaning that mechanical and aerodynamic function are not impaired. As noted above, an approximately + or – 5% profile tolerance is used herein. The X, Y and Z values are all non-dimensionalized relative to the airfoil height.

The disclosed airfoil shape optimizes and is specific to the machine conditions and specifications. The airfoil shape provides a unique profile to achieve (1) interaction between other stages in the high pressure turbine; (2) aerodynamic efficiency; and (3) normalized aerodynamic and mechanical blade loadings. The disclosed loci of points allow the gas turbine or any other suitable turbine to run in an efficient, safe and smooth manner. As also noted, any scale of the disclosed airfoil may be adopted as long as (1) interaction between other stages in the high pressure turbine; (2) aerodynamic efficiency; and (3) normalized aerodynamic and mechanical blade loadings are maintained in the scaled turbine.

The airfoil 250 described herein thus improves overall gas turbine 100 efficiency. Specifically, the airfoil 250 provides the desired turbine efficiency lapse rate (ISO, hot, cold, part load, etc.). The airfoil 250 also meets all aeromechanics and stress requirements.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

The invention claimed is:

1. A turbine bucket including a bucket airfoil having an airfoil shape, the bucket airfoil having a nominal profile substantially in accordance with Cartesian coordinate values of X, Y and Z set forth in Table 1 wherein the Cartesian coordinate values of X, Y and Z are non-dimensional values from 0% to 100% convertible to dimensional distances by multiplying the Cartesian coordinate values of X, Y and Z by a height of the bucket airfoil, and wherein X and Y are distances which, when connected by smooth continuing arcs, define airfoil profile sections at each distance Z, the airfoil profile sections at Z distances being joined smoothly with one another to form a complete airfoil shape.

2. The turbine bucket according to claim 1, forming part of a stage of a turbine.

3. The turbine bucket according to claim 1, wherein the airfoil shape lies in an envelope within at least one of, +/−5% and +/−5% of a chord length in a direction normal to any airfoil surface location.

4. The turbine bucket according to claim 1, wherein a height of the turbine bucket is about 4 inches to about 15 inches.

5. A turbine bucket including a bucket airfoil having a suction-side uncoated nominal airfoil profile substantially in accordance with suction-side Cartesian coordinate values of X, Y and Z set forth in Table 1 wherein the Cartesian coordinate values of X, Y and Z are non-dimensional values from 0% to 100% convertible to dimensional distances by multiplying the Cartesian coordinate values of X, Y and Z by a height of the bucket airfoil, and wherein X and Y are distances which, when connected by smooth continuing arcs, define airfoil profile sections at each Z distance, the airfoil profile sections at the Z distances being joined smoothly with one another to form a complete suction-side airfoil shape, the X, Y and Z distances being scalable as a function of the same constant or number to provide a scaled-up or scaled-down airfoil.

6. The turbine bucket according to claim 5, forming part of a stage of a turbine.

7. The turbine bucket according to claim 5, wherein the suction-side airfoil shape lies in an envelope within at least one of, +/−5% and +/−5% of a chord length in a direction normal to any airfoil surface location.

8. The turbine bucket according to claim 5, wherein a height of the turbine bucket is about 4 inches to about 15 inches.

9. A turbine comprising a plurality of buckets, each of the buckets including an airfoil having a suction-side airfoil shape, the airfoil having a nominal profile substantially in accordance with suction-side Cartesian coordinate values of X, Y and Z set forth in Table 1 wherein the Cartesian coordinate values of X, Y and Z are non-dimensional values from 0% to 100% convertible to dimensional distances in inches by multiplying the Cartesian coordinate values of X, Y and Z by a height of the airfoil in inches, and wherein X and Y are distances in inches which, when connected by smooth continuing arcs, define airfoil profile sections at each Z distance, the airfoil profile sections at the Z distances being joined smoothly with one another to form a complete suction-side airfoil shape.

10. The turbine according to claim 9, wherein the plurality of buckets comprise a stage of the turbine.

11. The turbine according to claim 9, wherein X represents a distance parallel to the turbine axis of rotation.

12. The turbine according to claim 9, wherein the suction-side airfoil shape lies in an envelope within at least one of, +/−5% and +/−5% of a chord length in a direction normal to any airfoil surface location.

13. The turbine according to claim 9, wherein a height of the bucket is about 4 inches to about 15 inches.

14. The turbine according to claim 9, wherein each of the buckets includes an airfoil having a pressure-side airfoil shape, the airfoil having a nominal profile substantially in accordance with pressure-side Cartesian coordinate values of X, Y and Z set forth in Table 1 wherein the Cartesian coordinate values of X, Y and Z are non-dimensional values from 0% to 100% convertible to dimensional distances in inches by multiplying the Cartesian coordinate values of X, Y and Z by a height of the airfoil, and wherein X and Y are distances which, when connected by smooth continuing arcs, define airfoil profile sections at each Z distance, the airfoil profile sections at Z distances being joined smoothly with one another to form a complete airfoil shape.

15. The turbine according to claim 14, wherein the plurality of buckets comprise a stage of the turbine.

16. The turbine according to claim 14, wherein X represents a distance parallel to the turbine axis of rotation.

17. The turbine according to claim 14, wherein the pressure-side airfoil shape lies in an envelope within at least one of, +/−5% and +/−5% of a chord length in a direction normal to any airfoil surface location.

18. A turbine according to claim 14, wherein a height of the bucket is about 4 inches to about 15 inches.

* * * * *